US006931810B2

(12) United States Patent
Beaudoin et al.

(10) Patent No.: US 6,931,810 B2
(45) **Date of Patent: *Aug. 23, 2005**

(54) WINDOW FRAMEWORK AND A METHOD FOR MOUNTING A GLASS PANE IN AN APERTURE OF A PANEL

(75) Inventors: Michel Beaudoin, Drummondville (CA); Luc Bourassa, St-Majorique (CA); Michel Lévesque, Drummondville (CA); Pascal Provencher, Drummondville (CA); Pierre-Louis Foucault, St-Lambert (CA); Normand Savard, Drummondville (CA); Douglas Kidd, Keller, TX (US)

(73) Assignee: Canimex Inc., Quebec (CA)

( * ) Notice: Subject to any disclaimer, the term of this patent is extended or adjusted under 35 U.S.C. 154(b) by 38 days.

This patent is subject to a terminal disclaimer.

(21) Appl. No.: 10/418,443

(22) Filed: Apr. 16, 2003

(65) Prior Publication Data

US 2004/0003554 A1 Jan. 8, 2004

(30) Foreign Application Priority Data

Apr. 18, 2002 (CA) ..... 2382606

(51) Int. Cl.[7] ..... E06B 3/70
(52) U.S. Cl. ..... 52/455; 52/213; 52/656.5
(58) Field of Search ..... 52/656.5, 656.9, 52/205, 717.01, 208, 212, 213, 204.54, 475.1, 204.5, 204.55, 455, 211, 217; 40/706, 732, 734, 308; 49/504, 505

(56) References Cited

U.S. PATENT DOCUMENTS

| | | | |
|---|---|---|---|
| 2,637,423 | A | 5/1953 | Creegan |
| 2,996,767 | A | 8/1961 | Kobil et al. |
| 3,760,543 | A | 9/1973 | McAllister |
| 3,903,669 | A | 9/1975 | Pease, Jr. et al. |
| 4,021,967 | A | 5/1977 | Mulder et al. |
| 4,241,556 | A | 12/1980 | Bursk |
| 4,525,961 | A | 7/1985 | Hansen |
| 4,839,989 | A | 6/1989 | McConnell |
| 4,841,696 | A | 6/1989 | Miller |
| 4,897,975 | A | 2/1990 | Artwick et al. |
| 5,018,330 | A | 5/1991 | Lewkowitz |

(Continued)

FOREIGN PATENT DOCUMENTS

| | | |
|---|---|---|
| GB | 1224560 | 3/1971 |
| GB | 2295844 | 6/1996 |
| GB | 2362676 | 11/2001 |

*Primary Examiner*—Carl D. Friedman
*Assistant Examiner*—Chi Q. Nguyen
(74) *Attorney, Agent, or Firm*—Merchant & Gould P.C.

(57) ABSTRACT

A window framework for mounting a glass pane in an aperture of a panel. The window framework includes an exterior frame having a peripheral wall shaped for fitting with and extending into the aperture. The peripheral wall extends between exterior and interior sides of the panel, and is provided along the periphery thereof with an abutment member adjacent to the exterior side. The wall is also provided with stop means adjacent to the interior side. The window framework also includes removable locking means having a flexible element lockable with the stop means when the locking means is in a locking position. The locking means is also provided with an element for holding the glass pane in position with the aid of the abutment member when the locking means is in the locking position. The window framework further includes a securing means for securing the exterior frame to the panel in the aperture. A method for mounting a glass pane in an aperture of a panel is also provided.

20 Claims, 26 Drawing Sheets

U.S. PATENT DOCUMENTS

| | | | | | |
|---|---|---|---|---|---|
| 5,133,168 | A | | 7/1992 | Neilly et al. | |
| 5,189,862 | A | | 3/1993 | Lafleur | |
| 5,283,995 | A | | 2/1994 | Richter | |
| 5,287,654 | A | * | 2/1994 | Davlantes | 49/169 |
| 5,323,579 | A | | 6/1994 | Ruff | |
| 5,369,923 | A | | 12/1994 | Schilt | |
| 5,430,982 | A | | 7/1995 | Bane | |
| 5,482,396 | A | | 1/1996 | Guillemet | |
| 5,497,588 | A | | 3/1996 | Martin et al. | |
| 5,577,355 | A | | 11/1996 | Leonelli | |
| 5,644,881 | A | | 7/1997 | Neilly | |
| 5,852,910 | A | | 12/1998 | Zebedee | |
| 6,101,772 | A | * | 8/2000 | Leonard et al. | 52/204.53 |
| 6,151,849 | A | | 11/2000 | Twigg et al. | |
| 6,272,801 | B1 | * | 8/2001 | Suh | 52/211 |
| 6,318,037 | B1 | | 11/2001 | Hansen | |
| 6,434,898 | B1 | | 8/2002 | Ward et al. | |
| 6,708,458 | B1 | * | 3/2004 | Berger, Jr. | 52/204.54 |
| 2003/0041539 | A1 | | 3/2003 | Bernacki et al. | |
| 2004/0000109 | A1 | * | 1/2004 | Bourassa et al. | 52/204.54 |

* cited by examiner

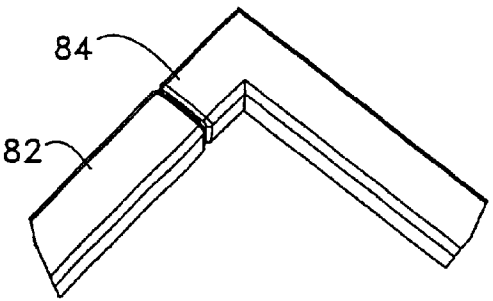
FIG. 36
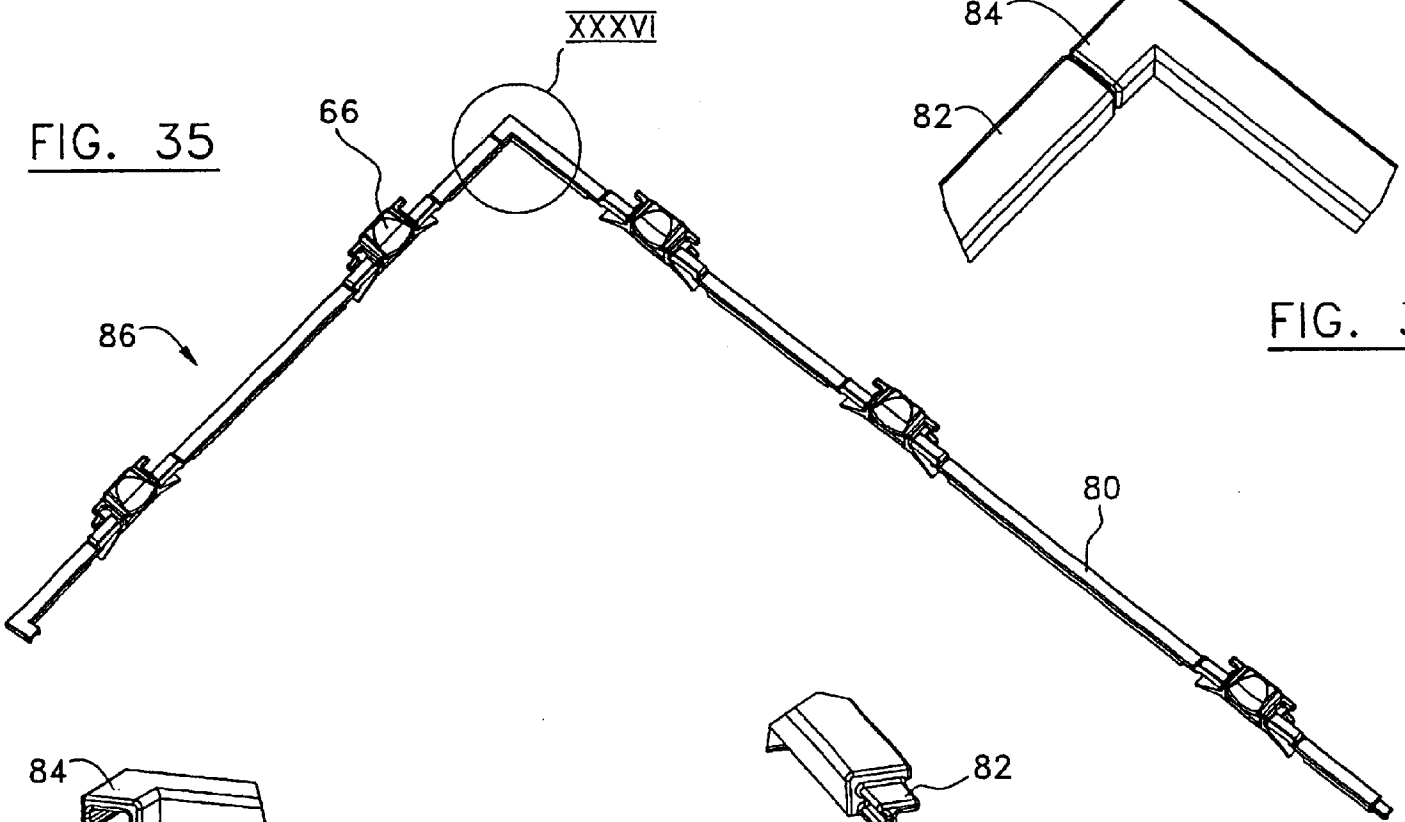
FIG. 35
FIG. 38
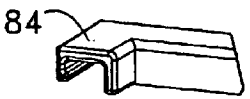
FIG. 37

WINDOW FRAMEWORK AND A METHOD FOR MOUNTING A GLASS PANE IN AN APERTURE OF A PANEL

FIELD OF THE INVENTION

The present invention generally relates to a window framework and a method for mounting a glass pane in a aperture of a panel. More particularly, the framework can be installed in doors, walls, and specially for garage doors.

BACKGROUND OF THE INVENTION

Breaking a door window glazing happens frequently, especially a garage door window. The existing frames on the market do not permit an easy installation or replacement of the glass. The usual way that the glass is actually assembled on the existing frames is to squeeze it between interior and exterior frames while assembling them. Therefore, when a glass breakage happens, the whole frame assembly must be disassembled from the door so as to remove the glass. In many cases, the frames are not strong enough to support the disassembling, since they were designed with the idea of permanent installation, and are often broken during the replacement procedure. Consequently, the whole frame must be changed. Moreover, such existing design requires two people to change the glass or the whole frame assembly in non-factory situations. One person must be outside to hold the exterior frame in place, while the other person holds the glass and the interior frame while screwing the frames together. Therefore, the glass replacement becomes complicated, labour intensive and time consuming.

Also known in the art, there is U.S. Pat. No. 5,323,579, granted on Jun. 28, 1994, to Robert O. RUFF. This patent describes a frame assembly including a retainer device allowing to mount a glazing between two frames that are mounted in an aperture made in the panels of a door. The retainer device comprises several U-shaped clips engageable on the rims of the aperture. The clips, which are preferably made of a springy material, are provided with two opposed flexible prongs for securing the glazing between the frames in the aperture. The prongs are provided with a release means allowing to remove the frames and the glazing with a single screw driver. This assembly does not require using tools and offers a quite simple mounting. However, these release means are accessible only when the glazing is broken and do not permit a replacement of the glazing without breaking it. Nevertheless, the frames and the retainer device are reusable.

Also known in the art, there is U.S. Pat. No. 4,897,975, granted on Feb. 6, 1990, to Kert E. ARTWICK et al. This patent describes an integral door light provided with an aperture and including an integral door light frame, a glazing and a plurality of retaining devices for securing the glazing within the frame. The glass is secured against the rims of the frame and is retained thanks to the retaining devices. The mounting does not require using additional fixation means such as screws. The retaining devices are removable subsequent to assembly, thereby allowing the glazing to be removed for servicing or replacement, as necessary. These retaining devices may include a spring structure for maintaining the glazing in firm contact with the frame and also allowing the door frame to accommodate glazing having slight thickness variations. However, the integral door light frame has to be structurally incorporated within the door and does not allow an easy removal or replacement thereof.

Also known in the art, there is U.S. Pat. No. 5,018,330, granted on May 28, 1991, to Bernd LEWKOWITZ. This patent describes a door light provided with an aperture. A plurality of glass holding clips are peripherally spaced about the door aperture to position and secure a pane of glass within the door aperture. Each clip includes mating interior and exterior members and the members are secured together by threaded fasteners which insert through aligned openings in the clip members. Interior and exterior decorative frames are then overfitted on the mating members of the clips.

Also known in the art, there are the following U.S. patents which describe different window framework assemblies: U.S. Pat. Nos. 5,430,982; 5,852,910; 6,434,898; 6,151,849; 3,760,543; 3,903,669; 4,021,967; 4,241,556; 4,525,961; 4,839,989; 4,841,696; 5,133,168; 5,189,862; 5,283,995; 5,369,923; 5,497,588; 5,577,355; 5,644,881; 6,151,849; 6,318,037 and U.S. patent application Ser. No. 2003/041539 A1.

None of the above-mentioned patents provides a window framework or a method for mounting a glass pane in an aperture of a panel where the glass pane can be removed or changed easily, in an efficient manner.

SUMMARY OF THE INVENTION

It is an object of the present invention to provide a window framework and a method for mounting a glass pane in an aperture of a panel where the glass pane can be removed or changed more easily and more efficiently than with window frameworks of the prior art.

Accordingly, there is provided a window framework for mounting a glass pane in an aperture of a panel. The window framework includes an exterior frame having a peripheral wall shaped for fitting with and extending into the aperture. The peripheral wall extends between exterior and interior sides of the panel, and is provided along the periphery thereof with an abutment member adjacent to the exterior side. The wall is also provided with stop means adjacent to the interior side. The window framework also includes removable locking means having a flexible element lockable with the stop means when the locking means is in a locking position. The locking means is also provided with an element for holding the glass pane in position with the aid of the abutment member when the locking means is in the locking position. The window framework further includes a securing means for securing the exterior frame to the panel in the aperture.

In a preferred embodiment of the present invention, the stop means includes first and second stops built in the wall for providing two locking positions for holding a glass pane of different predetermined thicknesses.

According to the present invention, there is also provided a method for mounting a glass pane in an aperture of a panel, comprising steps of:

a) mounting an exterior frame on an exterior side of the panel, the exterior frame having a peripheral wall shaped for fitting with and extending into the aperture, the wall extending between exterior and interior sides of the panel, the wall having along periphery thereof an abutment member adjacent to the exterior side, and stop means adjacent to the interior side;

b) securing the exterior frame to the panel in said aperture;

c) after steps a) and b), mounting the glass pane into the aperture on the interior side against the abutment member; and d) holding the glass pane in position by means of removable locking means having a flexible element lockable with said stop means when the locking means is in a locking position, and an element for holding the glass pane in position with aid of the abutment member when the locking means is in said locking position.

In a preferred embodiment of the present invention, the method further comprises step e) of releasing the glass pane by inserting an elongated member into a recessed channel extending in the peripheral wall in adjacent relationship with the stop means, the recessed channel allowing an access from the interior side to the flexible element to unlock the flexible element of the locking means.

BRIEF DESCRIPTION OF THE DRAWINGS

A detailed description of preferred embodiments will be given hereinbelow with reference to the following drawings, in which like numbers refer to like elements:

FIG. 35 is a partial perspective view of the elongated elements of the peripheral strip shown in FIG. 29, in an assembled position.

FIG. 36 is an enlarged view of a portion of FIG. 35.

FIG. 37 is a front perspective view of an element shown in FIGS. 35 and 36.

FIG. 38 is a front perspective view of another element shown in FIGS. 35 and 36.

Figure 1:
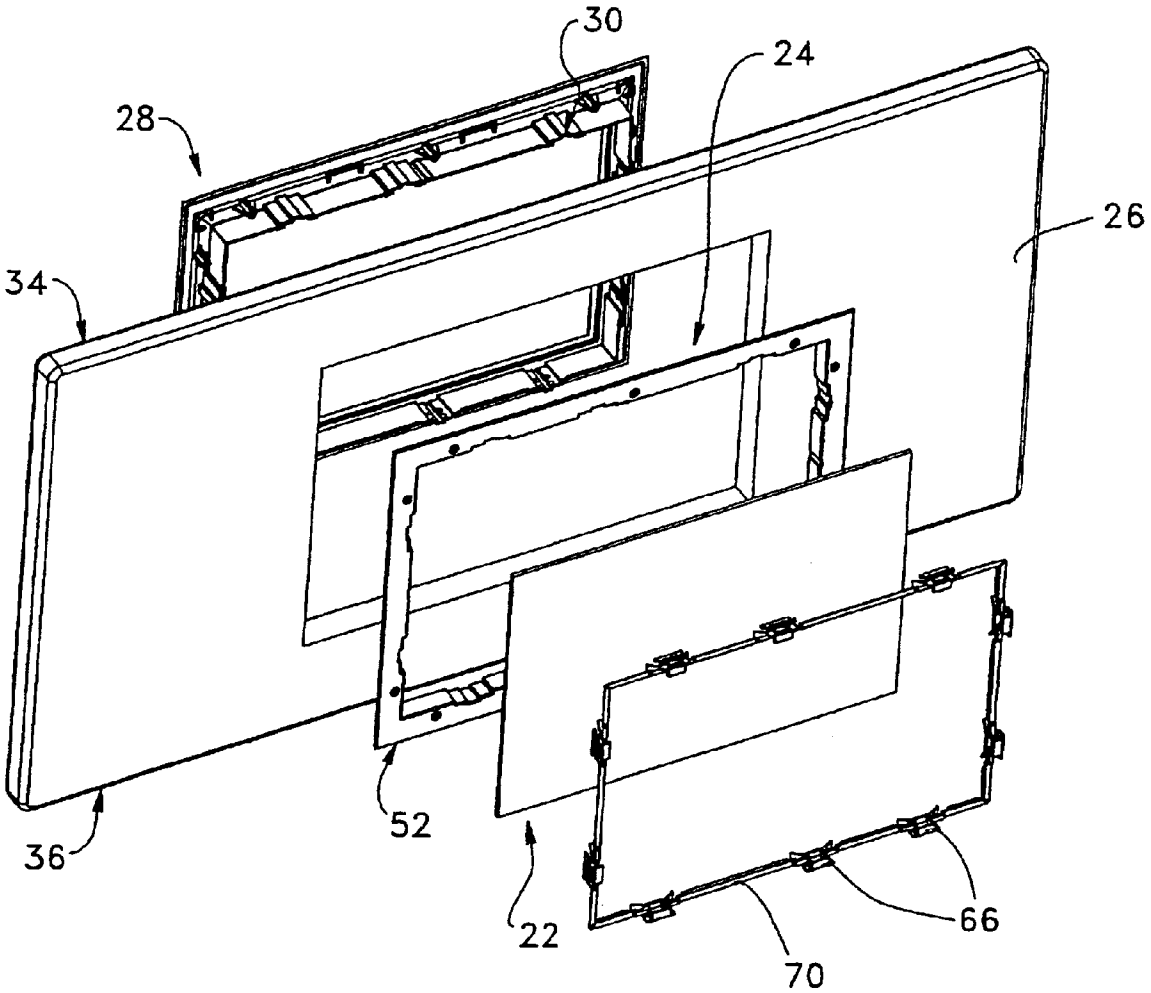
FIG. 1 is an exploded perspective view of a window framework according to a first preferred embodiment of the present invention, in relation with a glass pane and a panel partially shown.

The objects, advantages and other features of the present invention will become more apparent upon reading of the following non-restrictive description of the preferred embodiments thereof, given for the purpose of exemplification only with reference to the accompanying drawings.

DETAILED DESCRIPTION OF THE DRAWINGS

In the following description of preferred embodiments, similar features in the drawings have been given the same reference numerals and in order to weight down the figures, some elements are not referred to in some figures if they were already identified in a precedent figure.

The present invention concerns a window framework for mounting a glass pane in an aperture of a panel where the glass pane can be removed or changed more easily and more efficiently than with window frameworks of the prior art and without requiring frame disassembly.

Moreover, the present invention provides a window framework allowing glazing to be installed or removed from the exterior frame before, during or after the window framework is installed, without any interaction with an interior frame. Furthermore, in a preferred embodiment of the present invention that will be detailed hereinafter, there is provided a window framework allowing switching from different thicknesses, such as for example, 3/32", 1/8" or 1/2" thick glazing or vice-versa, without having to change the window framework assembly and specifically without changing the glazing clips.

Referring to FIGS. 1 to 10, there is shown a window framework 20 for mounting a glass pane 22 in an aperture 24 of a panel 26 according to the present invention. The window framework 20 is preferably made of plastic material but any other convenient material could also be envisaged. The window framework 20 includes an exterior frame 28 having a peripheral wall 30 shaped for fitting with and extending into the aperture 24 of the panel 26. Preferably, the exterior frame 28 further includes an abutment wall 32 projecting outwardly for resting on the exterior side 34 of the panel 26, as can be better seen in FIG. 10. The peripheral wall 30 of the exterior frame 28 extends between exterior and interior sides 34, 36 of the panel 26. The peripheral wall 30 has along periphery thereof an abutment member 38 adjacent to the exterior side 34, and stop means adjacent to the interior side 36 of the panel 26. Preferably, the stop means includes first stops 42 built in the peripheral wall 30 along periphery thereof. More preferably, the stop means further includes second stops 44 built in the peripheral wall 30. The second stops 44 extend respectively in an alignment relationship with the first stops 42 between the interior and exterior sides 36, 34 of the panel 26, thereby providing two locking positions for holding a glass pane 22 of different thicknesses.

The window framework 20 also includes removable locking means having preferably several locking elements 66, each having a flexible element 48 lockable with one of the corresponding stops 42, 44 of the stop means when the locking means is in a locking position. The locking means also has an element for holding the glass pane 22 in position with aid of the abutment member 38 when the locking means is in a locking position. Preferably, the element for holding the glass pane 22 in position is a resilient element. Even more preferably, the resilient element includes two angularly oriented flexible pressure legs 50, as can be better seen in FIGS. 5 to 8. Once the locking means has been snapped in place, the pressure legs 50 apply a certain pressure on the glass pane 22 to keep it in place. This locking means can be snapped at two different locations, in the corresponding first or second stops 42, 44 to accommodate different glass thicknesses.

Figure 5:
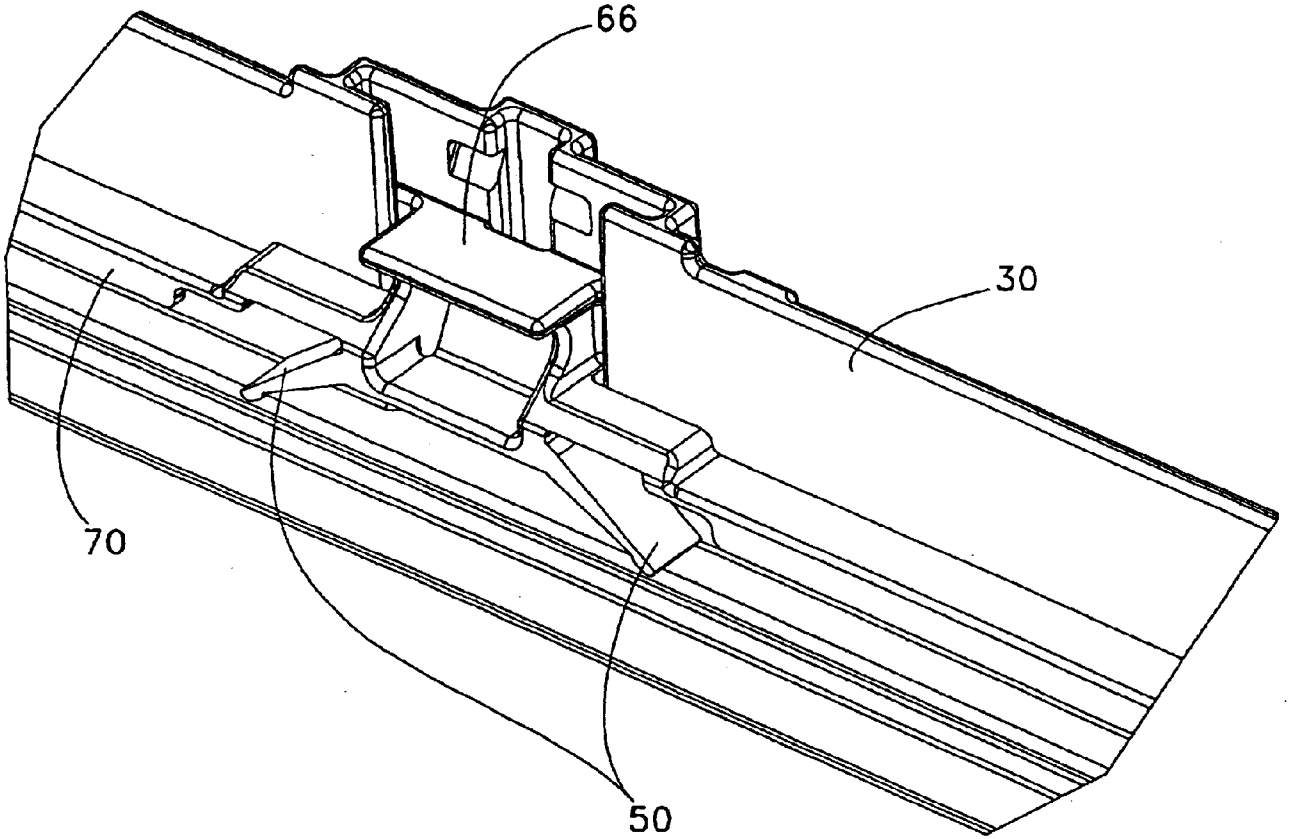
FIG. 5 is a perspective partial view of the exterior frame of FIG. 4, in is relation to a locking element of the window framework shown in FIGS. 1 to 4, in a first operating position.
Figure 6:
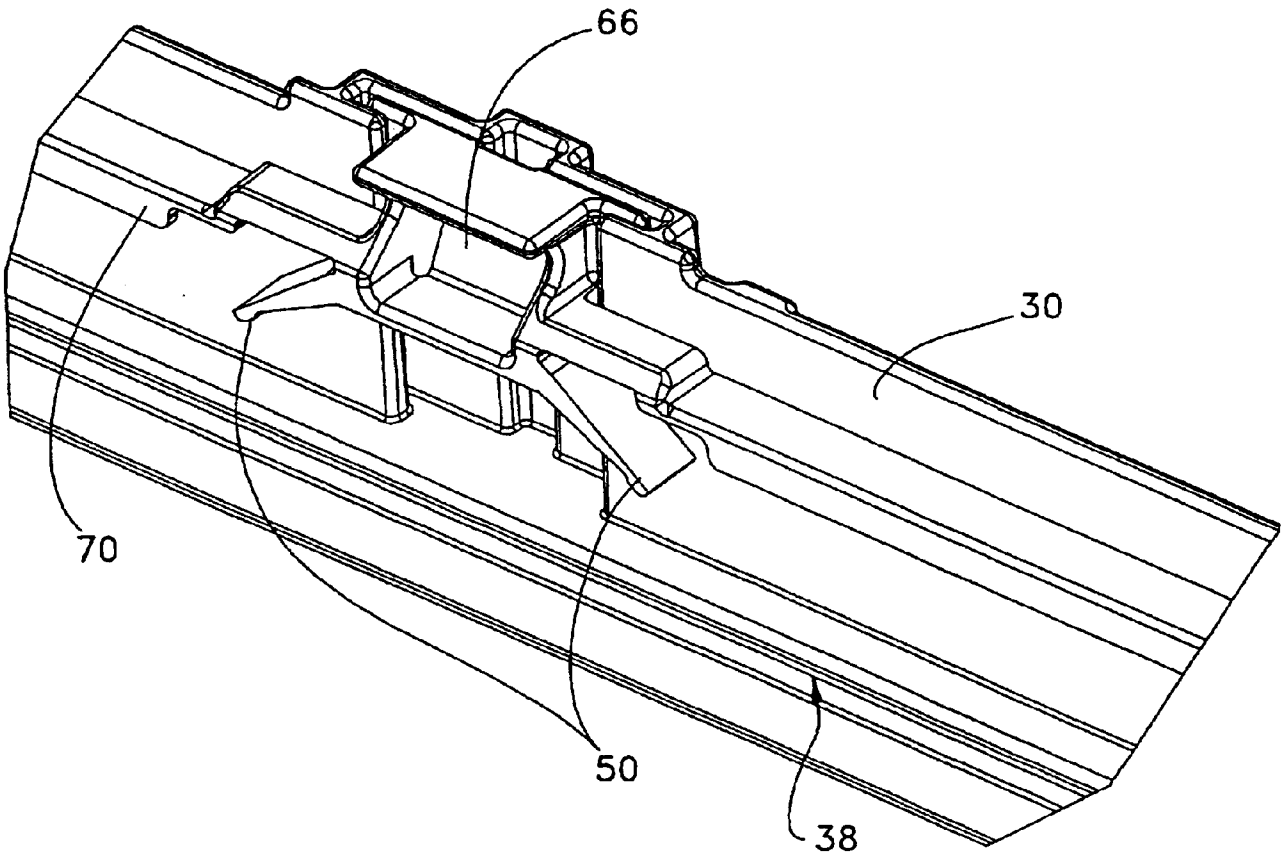
FIG. 6 is a perspective partial view of the elements shown in FIG. 5, in a second operating position.
Figure 7:
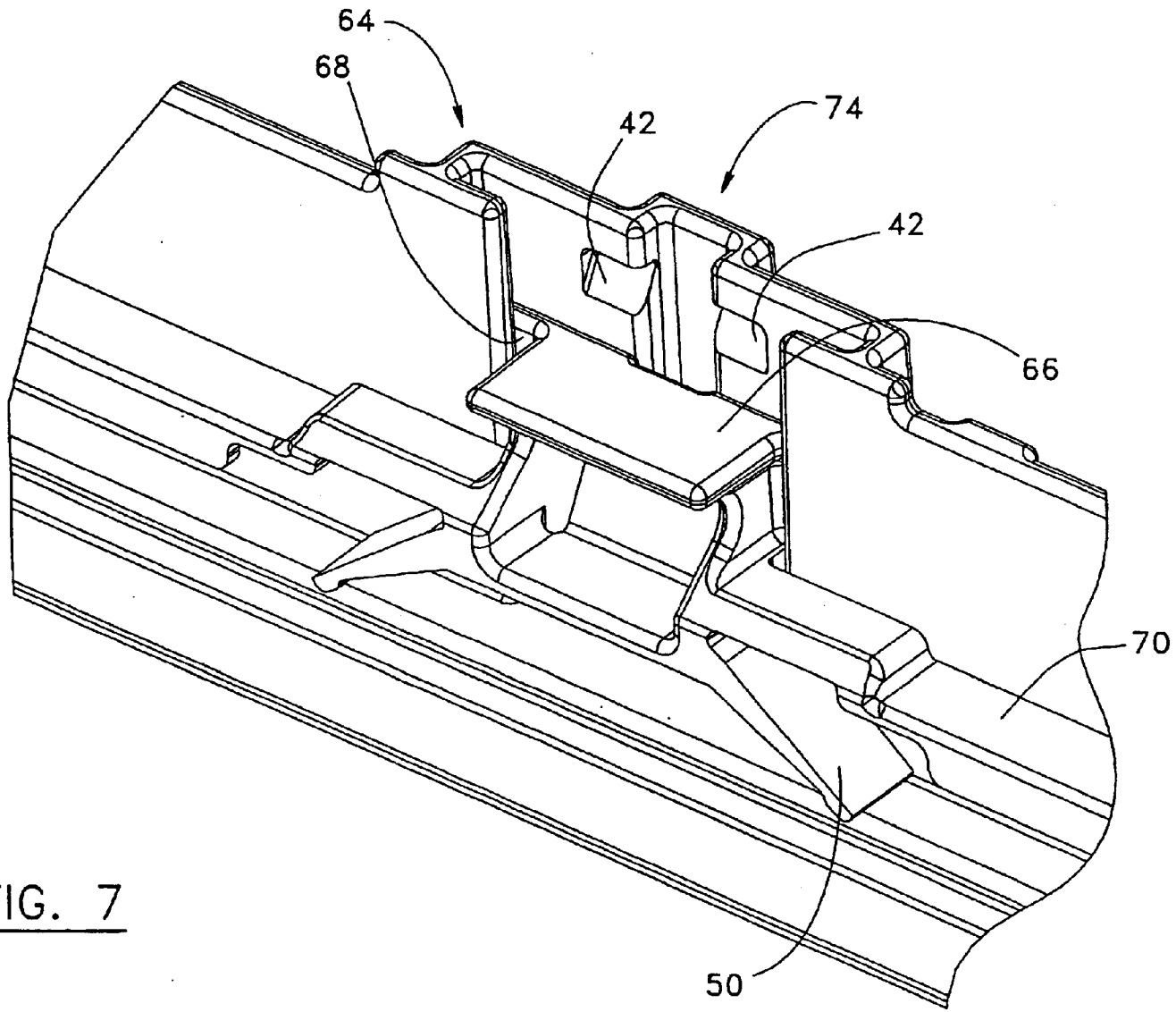
FIG. 7 is another perspective partial view of the elements shown in FIG. 5.
Figure 8:
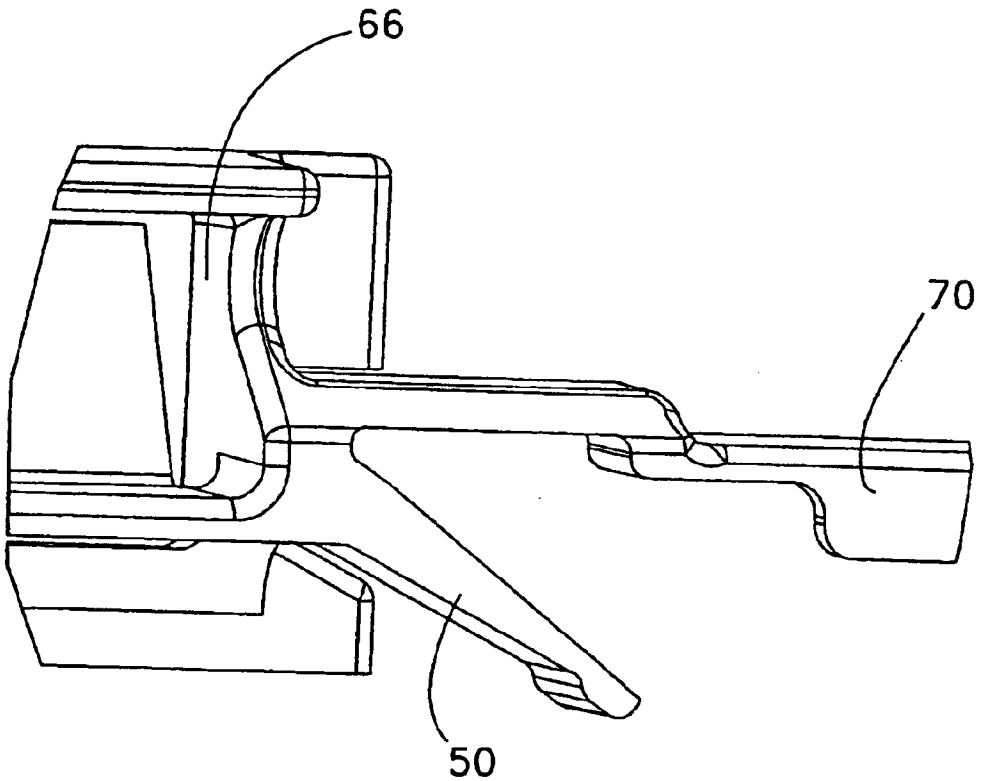
FIG. 8 is a partial front view of a locking element of the window framework shown in FIGS. 1 to 7.
Figure 9:
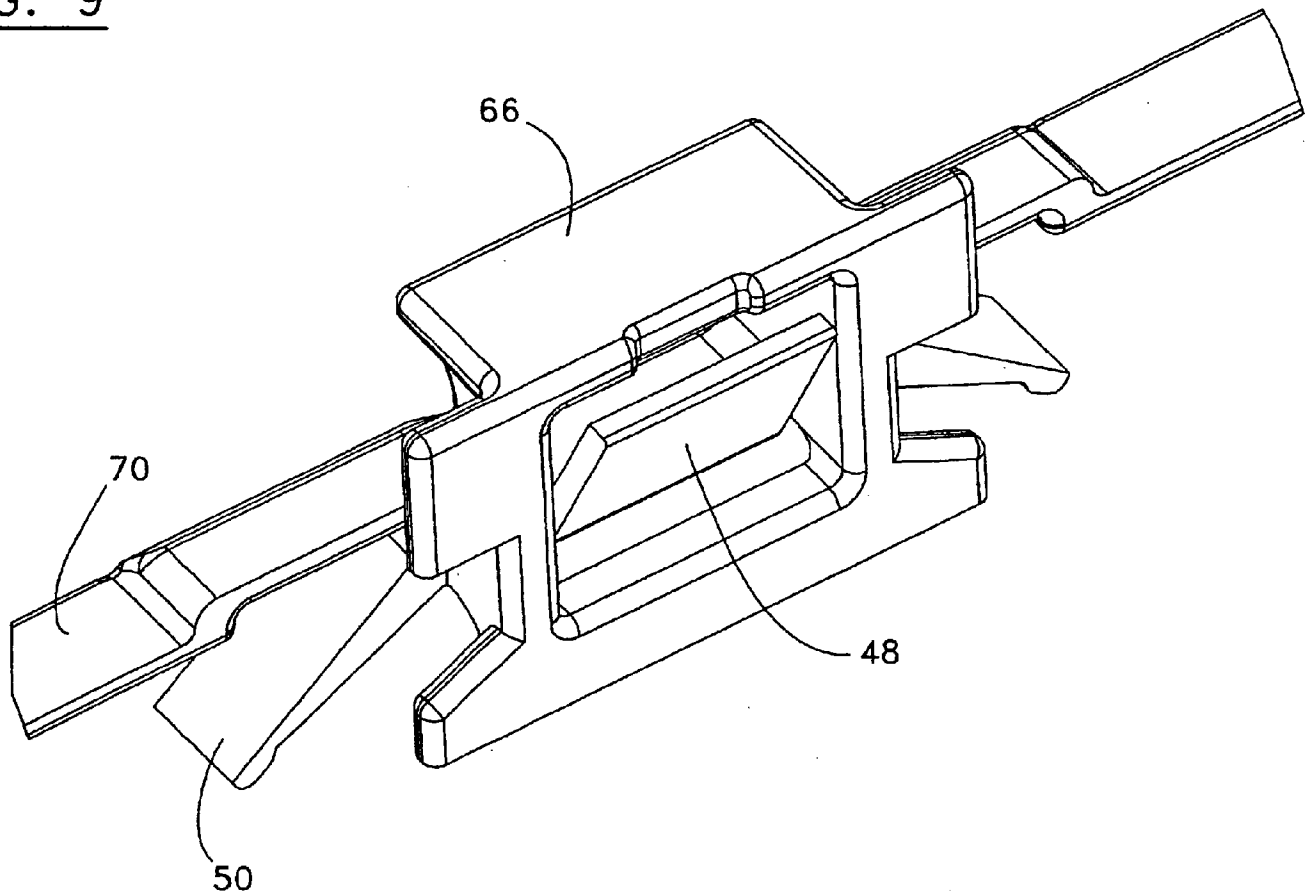
FIG. 9 is a rear and side perspective view of a locking element of the window framework shown in FIGS. 1 to 8.
Figure 10:
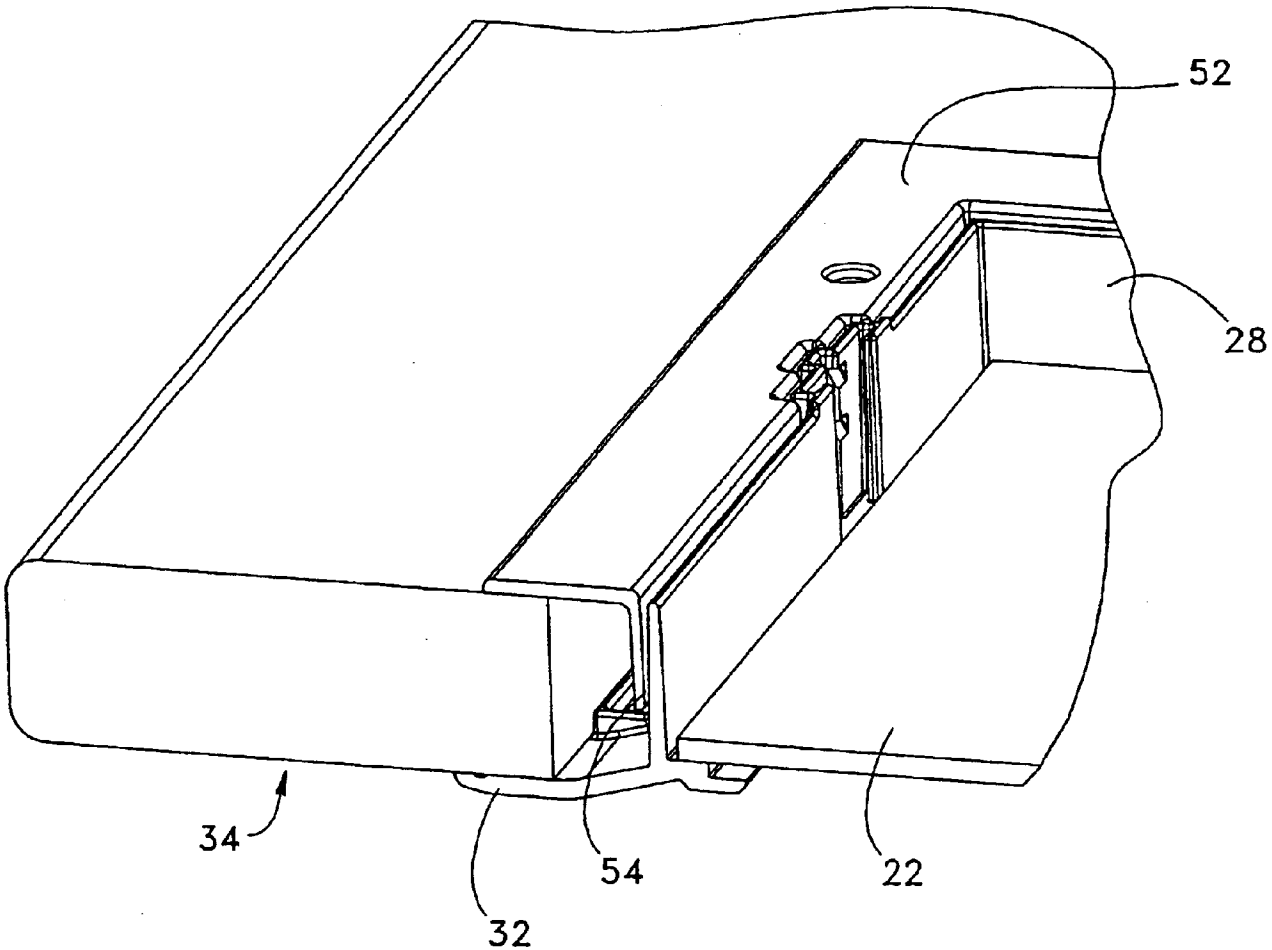
FIG. 10 is a partial perspective section view along line 10—10 of FIG. 3 where the locking means of the window framework has been omitted.

FIG. 5 shows a locking element 66 locked in the second stops 44 at the lower position for the SSB and DSB glasses, which are about 3/32" and 1/8" thick. FIG. 6 shows a locking element 66 locked in the first stops 42 at the highest position for the Thermos glass, which is about 1/2" thick. Thus, the first and second stops 42, 44 cover the difference between 1/8" and 1/2" glasses and the pressure legs 50 cover the tolerance variation of each glass thickness. Consequently, the present window framework 20 can be used with any glass thickness between 0.085" to 0.156" and 0.468" to 0.532" for example. Nevertheless, it must be understood that the present window framework 20 could also be designed to accommodate other glass thicknesses.

Still referring to FIGS. 1 to 10, the window framework 20 is also provided with a securing means for securing the exterior frame 28 to the panel 26 in the aperture 24. Preferably, in the first illustrated embodiment, the securing means includes an interior frame 52 having a peripheral wall 54 shaped for fitting into the aperture 24 of the panel 26, and a connecting means for connecting the two frames 28, 52 together and securing the same into the aperture 24. Still preferably, the connecting means includes screws 58 and holes 60 provided in the frames for securing the exterior frame 28 to the panel 26 by screwing the screws 58 in the holes 60. Of course, any other convenient securing means could also be used for securing the exterior frame 28 to the panel 26 in the aperture 24.

With Reference now to FIGS. 4 to 7 and FIG. 9, in the first preferred illustrated embodiment, the peripheral wall 30 of the exterior frame 28 is preferably further provided with a guiding means for guiding the locking means along the peripheral wall 30 in and out of the locking position. Preferably, the guiding means includes several guides, each of the guides including two opposed slotted guiding channels 64 spread along the peripheral wall 30. Moreover, each of the locking elements 66 includes opposite edges 68 shaped for sliding in the slotted guiding channels 64 of the corresponding guide.

Figure 2:
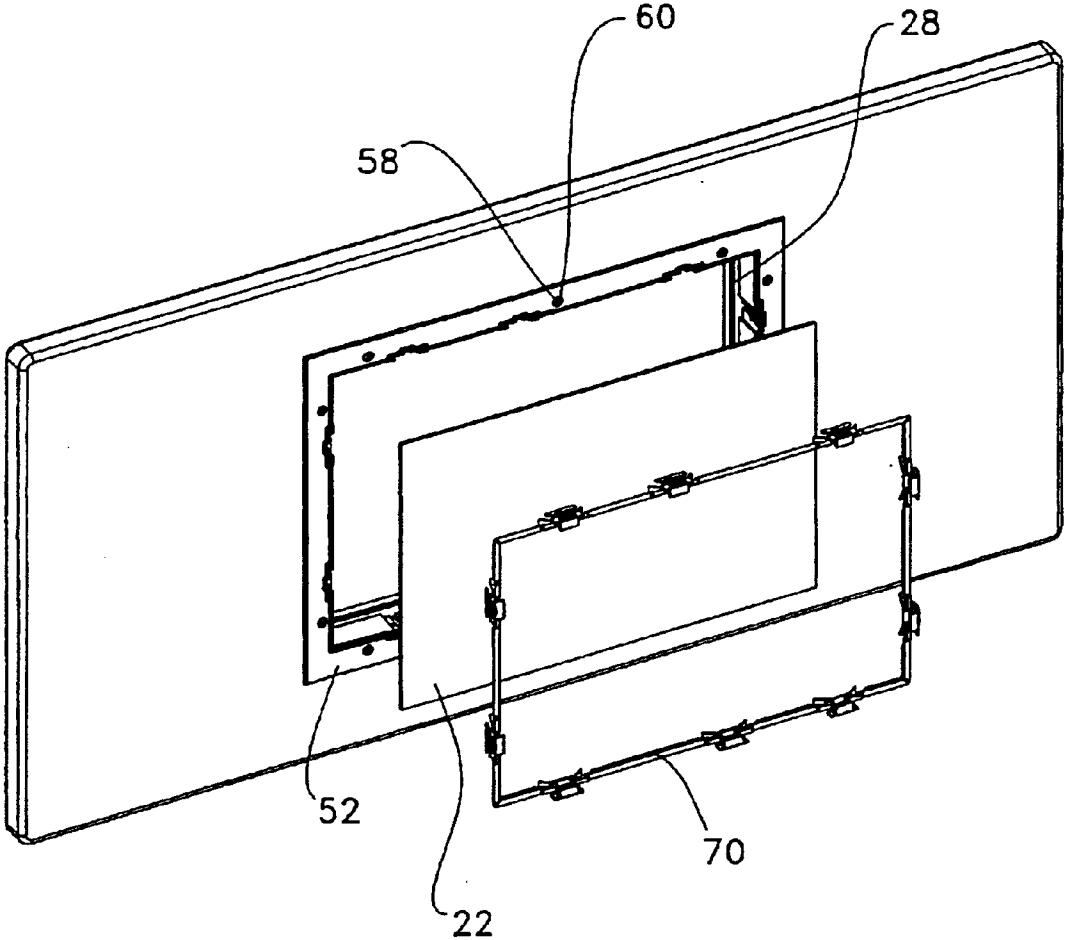
FIG. 2 is a perspective view of the elements shown in FIG. 1, where two elements thereof are shown in an exploded view.
Figure 3:
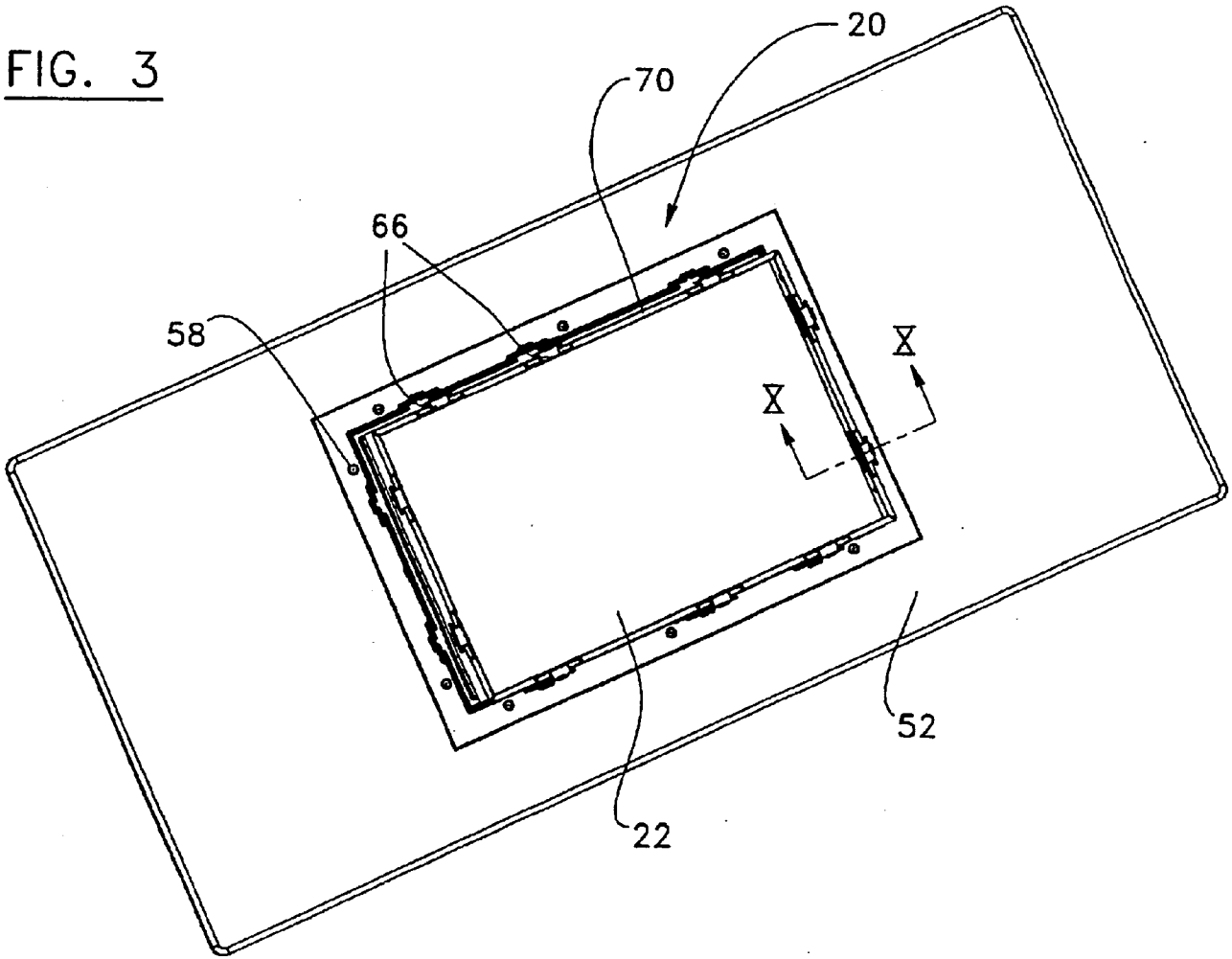
FIG. 3 is a front view of the elements shown in FIGS. 1 and 2, in an assembled position.
Figure 4:
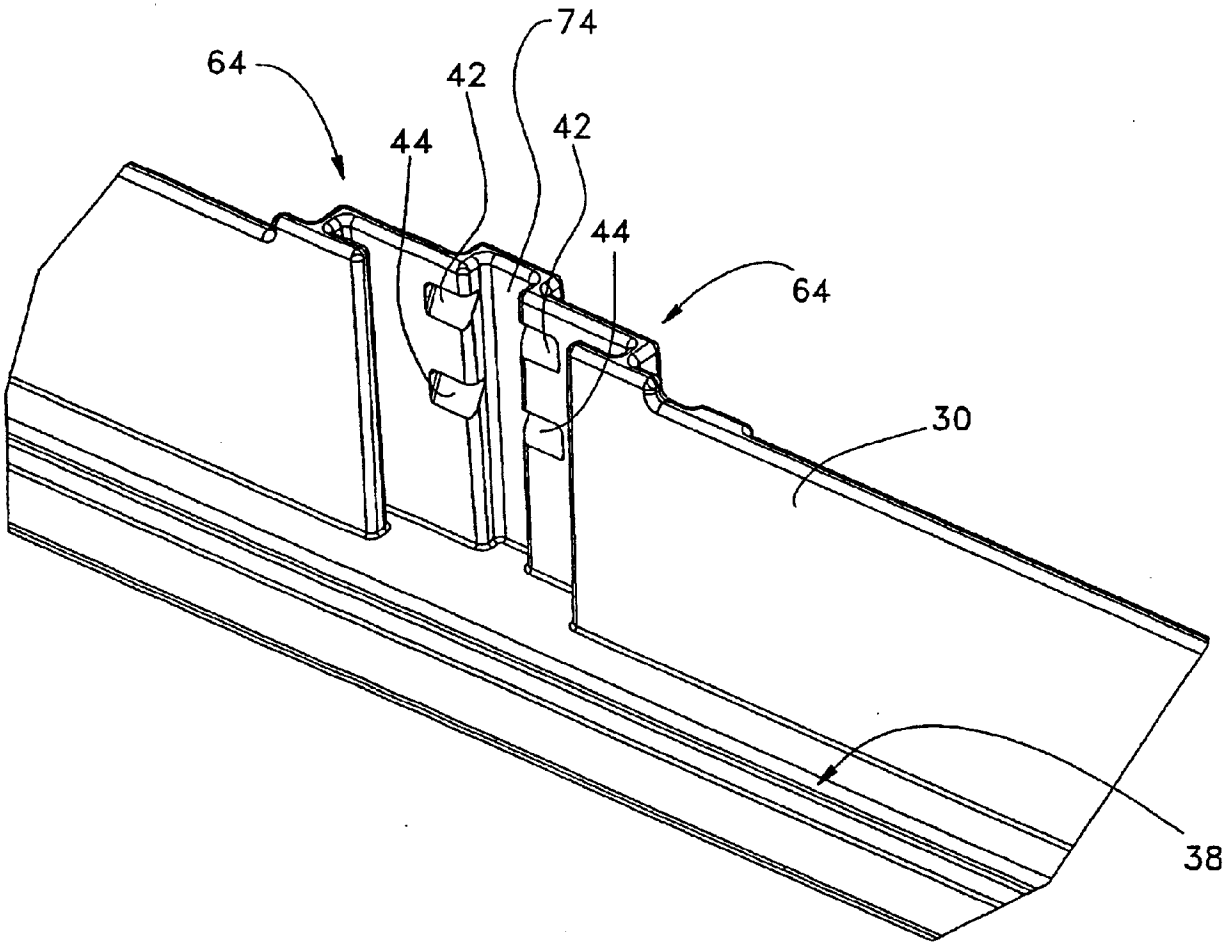
FIG. 4 is a perspective partial view of a portion of an exterior frame of the window framework shown in FIGS. 1 to 3.

Referring now to FIGS. 1 to 3, the locking means may preferably includes a strip 70 for linking together the locking elements 66, thereby facilitating a guiding of each of the locking elements 66 along the corresponding guide. Moreover, such a strip 70 renders the present window framework 20 more aesthetic by hiding the glass edges.

Preferably, with reference to FIG. 29 and FIGS. 35 to 38, the locking means may also further comprise links 80 for linking the locking elements 66 into a locking frame 86 shaped for fitting and extending into the interior frame 52 from the interior side 36. The locking frame may comprise at least two sections. Each of the sections is provided with female and male extremities 84, 82 for disengageably connecting together the at least two sections. Thus, preferably, the at least two sections connect to each other in the frame corners by overlapping in snapping together to secure their connection, thereby finalising the glass edges.

Referring again to FIGS. 1 to 10, as already said, the frames installation may be performed separately from the glass replacement. In fact, once a cut-out is made in the panel 26, only one person is required to install the frame. According to the present invention, there is also provided a method for mounting a glass pane in an aperture of a panel, comprising steps of:

a) mounting an exterior frame on an exterior side of the panel, the exterior frame having a peripheral wall shaped for fitting with and extending into the aperture, the wall extending between exterior and interior sides of the panel, the wall having along periphery thereof an abutment member adjacent to the exterior side, and stop means adjacent to the interior side;

b) securing the exterior frame to the panel in said aperture;

c) after steps a) and b), mounting the glass pane into the aperture on the interior side against the abutment member; and d) holding the glass pane in position by means of removable locking means having a flexible element lockable with said stop means when the locking means is in a locking position, and an element for holding the glass pane in position with aid of the abutment member when the locking means is in said locking position.

Also preferably, the installer can place the exterior frame 28 in the cut-out outside the panel 26 and holds it there with one hand from inside the room, which can be a garage for example. He then places the interior frame 52 in the cut-out inside the room with the other hand. He holds them in place with the first hand and places screws 58 in each screwing hole 60 with the other hand and screws the frames 28, 52 in place.

Also, it should be noted that the exterior frame 28 can be secured to the panel 26. Now, one can mount the glass pane 22. The installer has only to place the glass pane 22 into the exterior frame 28, inside its peripheral wall 30. He holds the glass pane 22 in place while installing the locking means on the peripheral wall 30 of the exterior frame 28. To properly install it, he only has to align the locking elements 66 in the corresponding guide of the peripheral wall 30, and push each locking elements 66 toward the glass pane 22 to get it locked.

Then the glass pane 22 is installed. The guides prevent the locking elements 66 to move toward the center of the frame due to the locking forces. What makes each locking element 66 locked in place is the flexible element 48. In the preferred illustrated embodiment, the flexible element 48 protrudes out of the back surface of the locking element 66 when in its natural position. So, when the installer pushes each locking element 66 down into the corresponding guide, that flexible element 48 is pushed toward inside the frame until that element 48 arrives at the right clipping slot. When that happens, the flexible element 48 returns back to its natural position and the locking element 66 is then locked. To properly secure the glass pane 22, an appropriate number of locking elements 66 have to be locked on the exterior frame 28. Ten locking elements are shown on the accompanying figures but it should be noted that any number of locking elements 66 could be used, according to the size of the aperture 24 for example.

Figure 11:
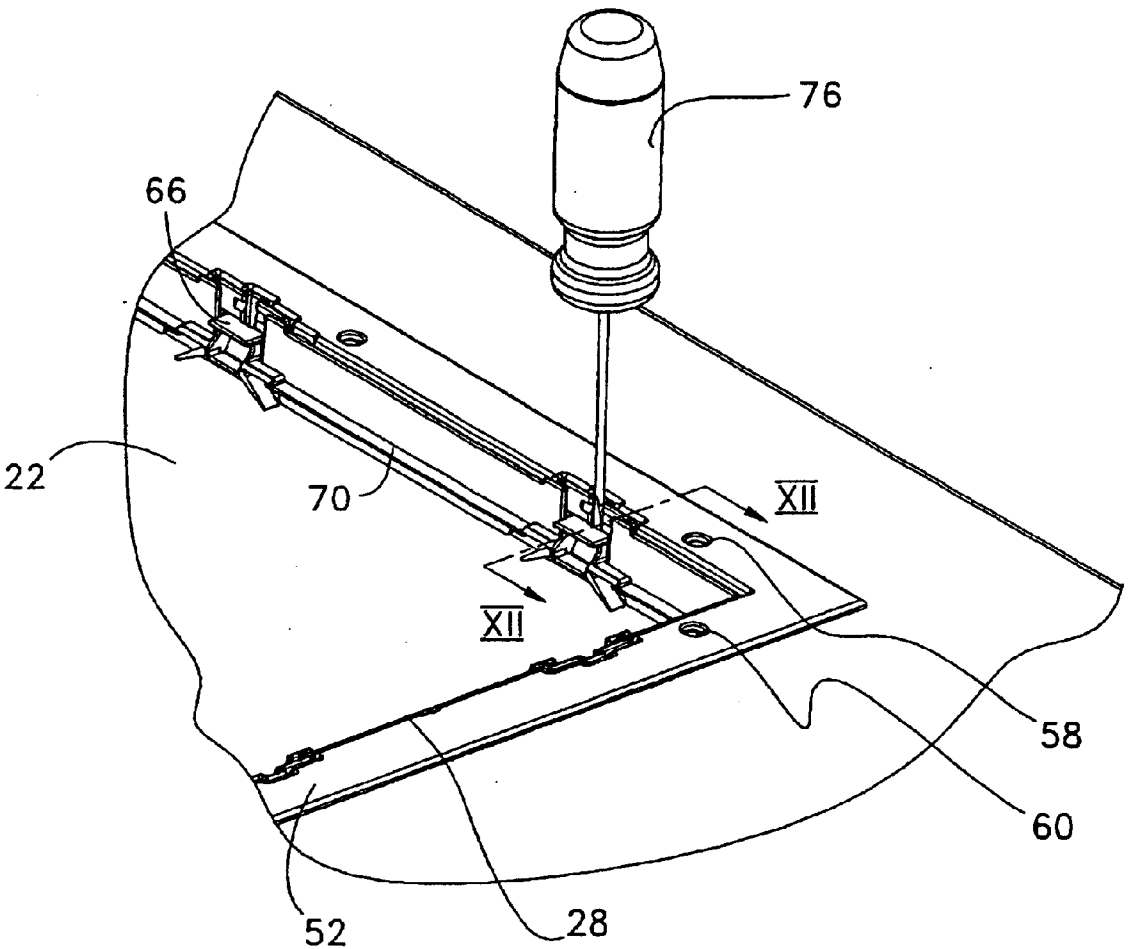
FIG. 11 is a partial perspective view of elements shown in FIG. 3 where a partial view of a screwdriver has been added.
Figure 12:
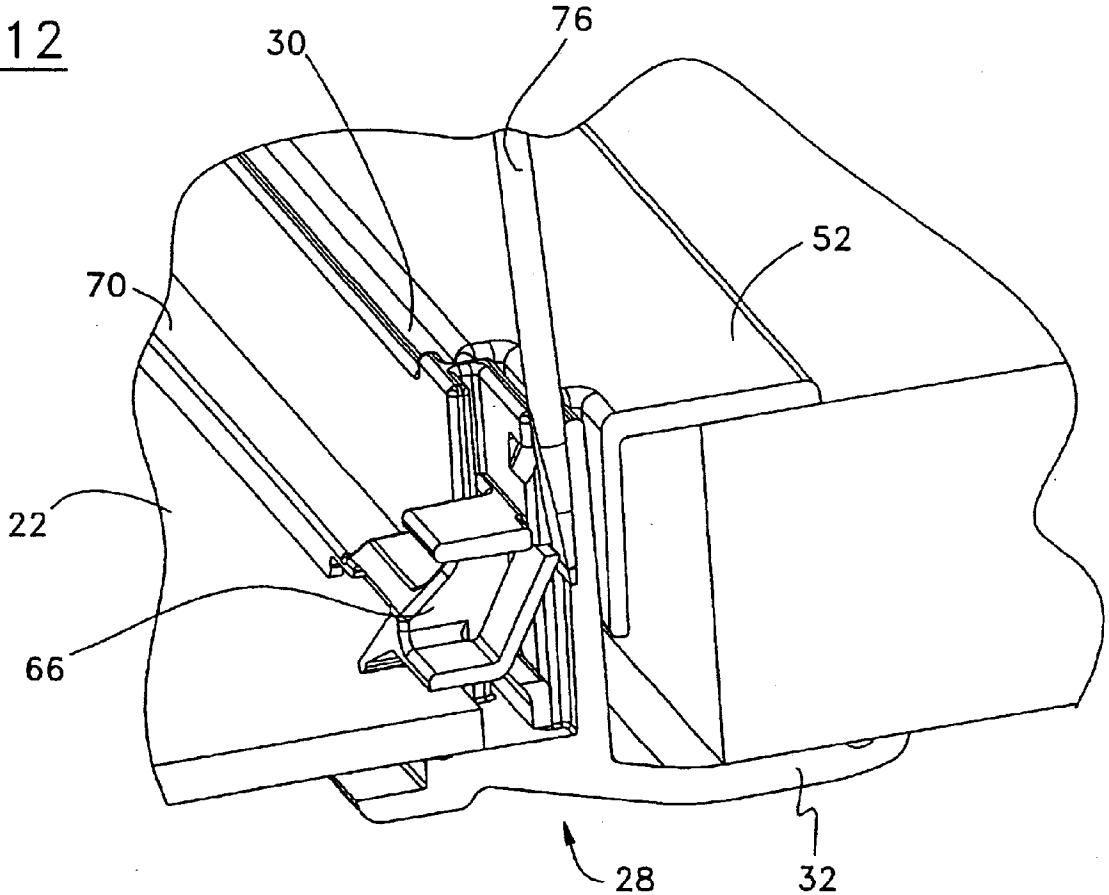
FIG. 12 is a partial perspective section view along line 12—12 of FIG. 11.
Figure 13:
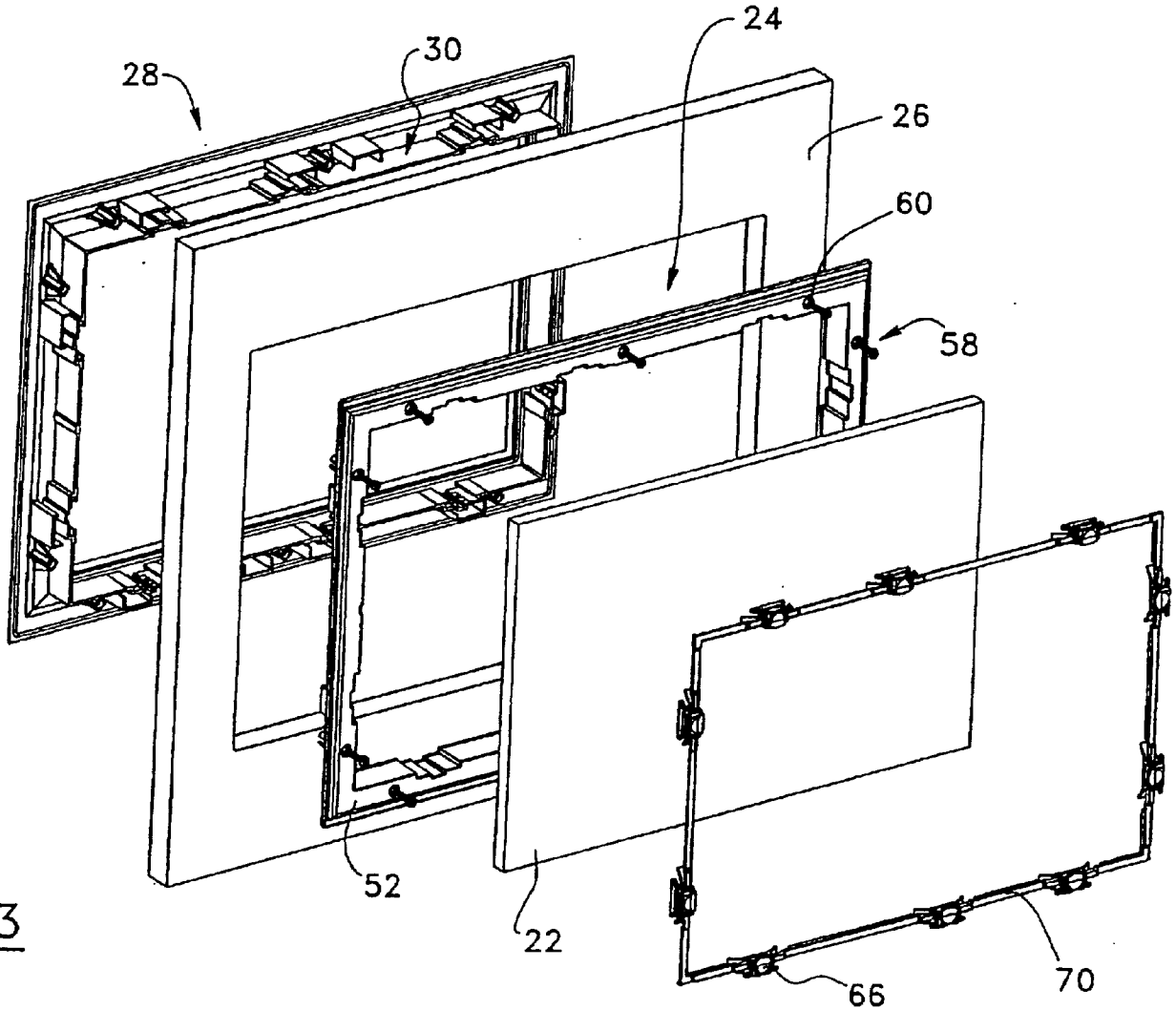
FIG. 13 is an exploded perspective view of a window framework according to a second preferred embodiment of the present invention, in relation with a glass pane and a panel.
Figure 14:
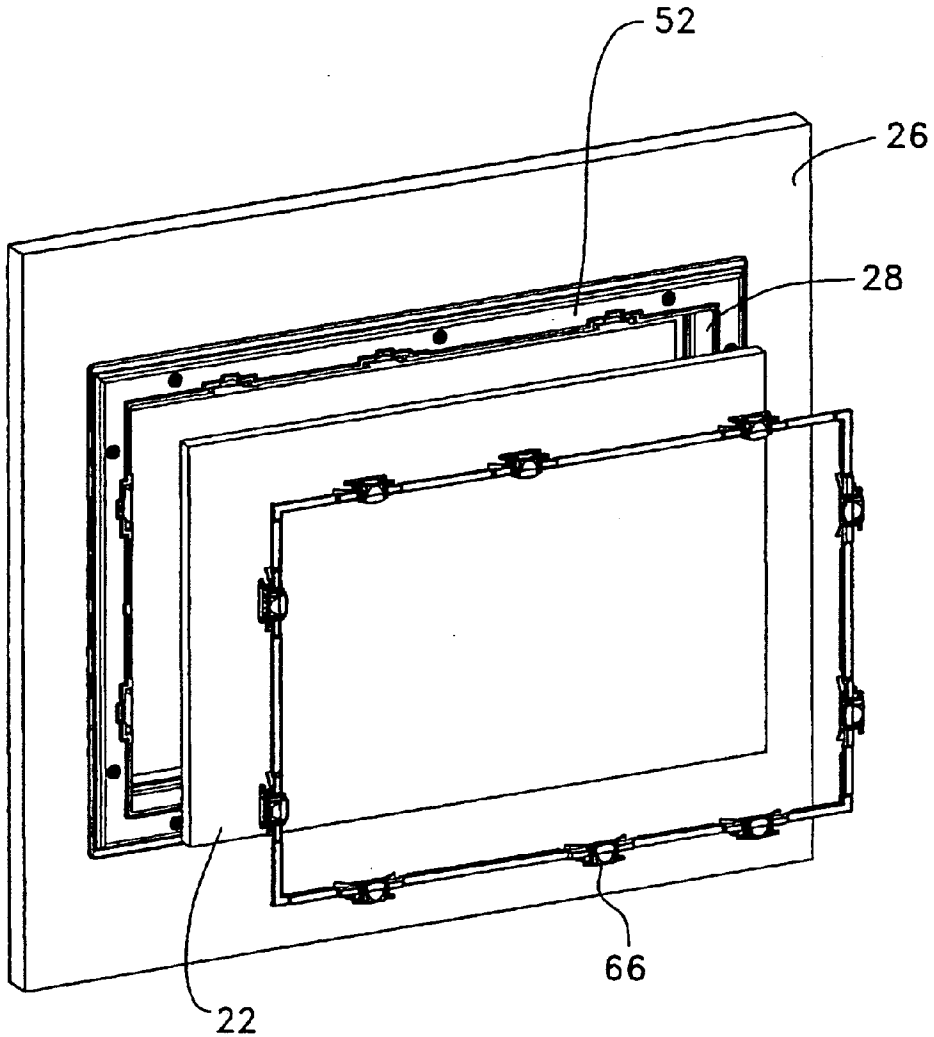
FIG. 14 is a perspective view of the elements shown in FIG. 13, where two elements thereof are shown in an exploded view.
Figure 15:
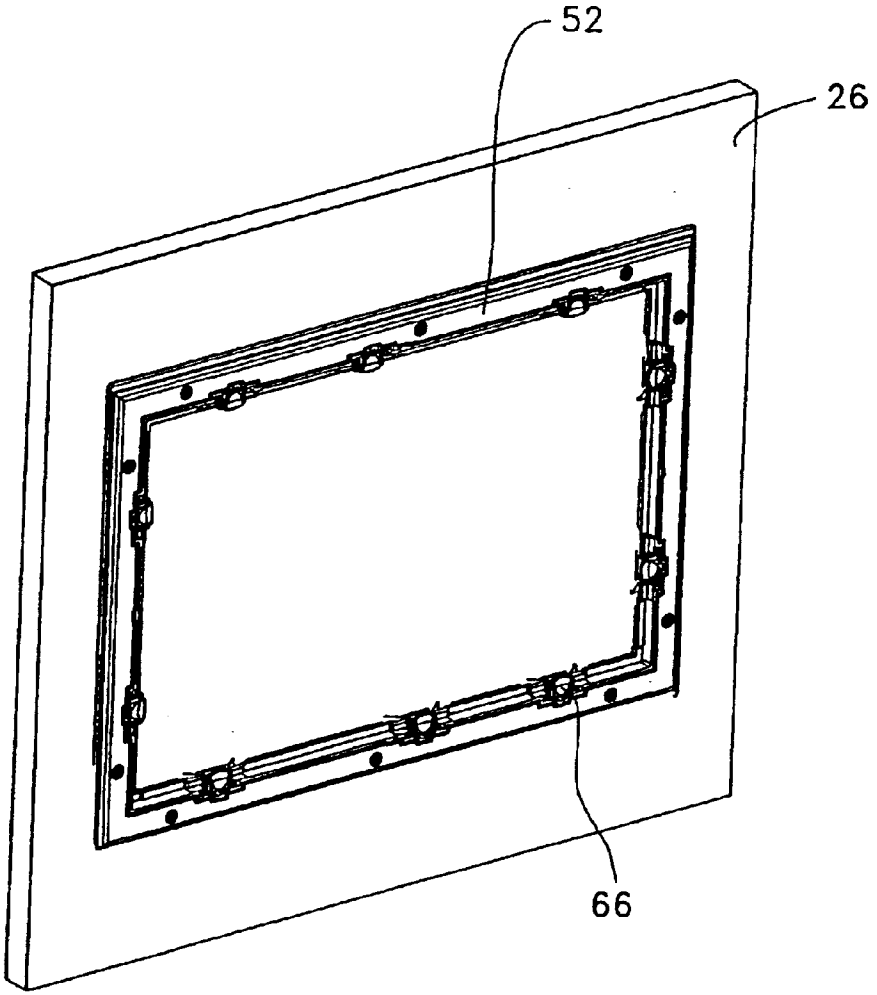
FIG. 15 is a front view of the elements shown in FIGS. 13 and 14, in an assembled position.
Figure 16:
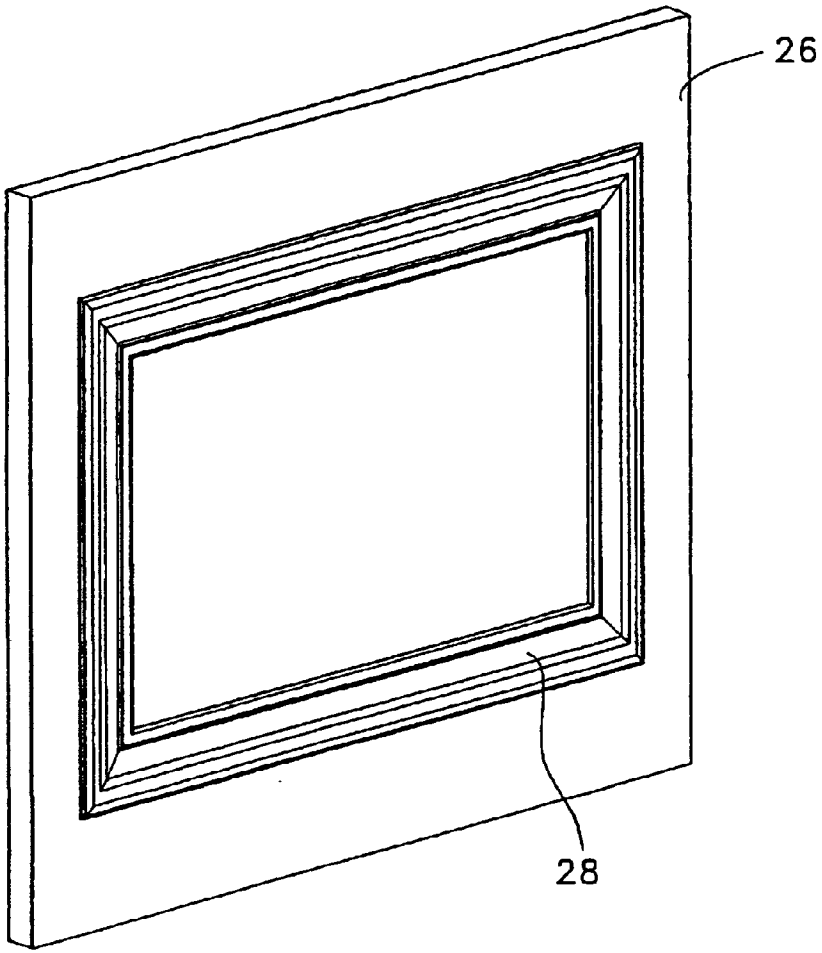
FIG. 16 is a rear view of the elements shown in FIGS. 13 and 14, in an assembled position.
Figure 18:
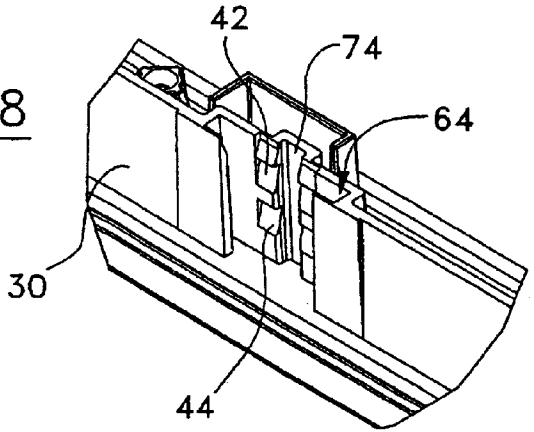
FIG. 18 is an enlarged view of a portion of FIG. 17.
Figure 17:
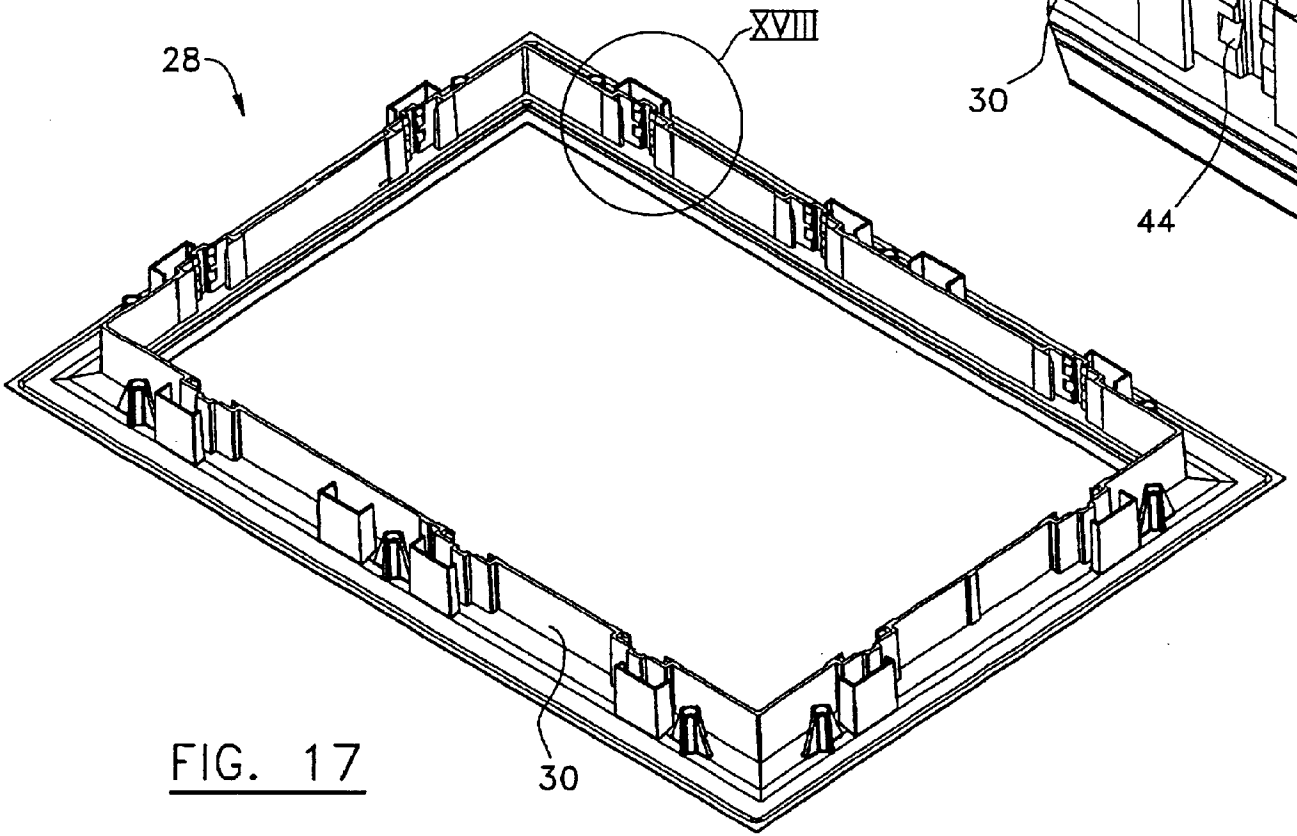
FIG. 17 is an elevation perspective view of an exterior frame of the window framework shown in FIGS. 13 to 15.
Figure 19:
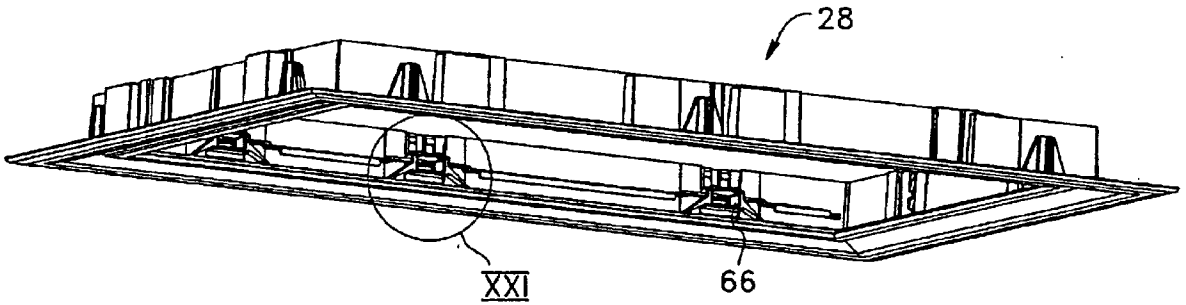
FIG. 19 is another perspective view of the exterior frame shown in FIG. 17.
Figure 20:
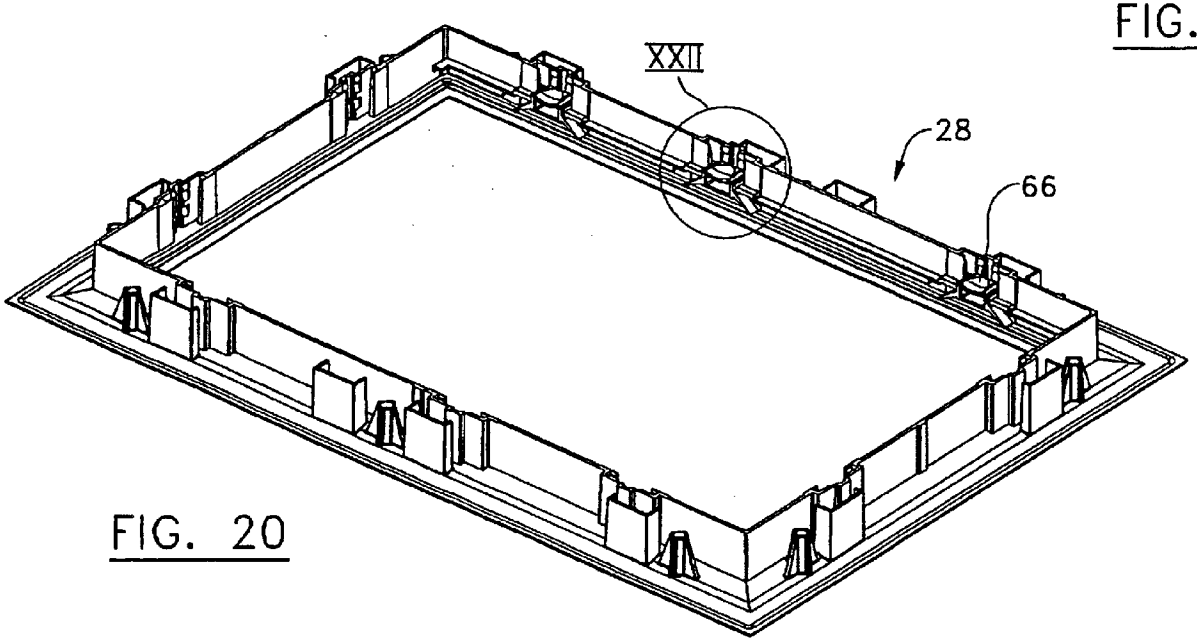
FIG. 20 is another perspective view of the exterior frame shown in FIG. 17.
Figure 22:
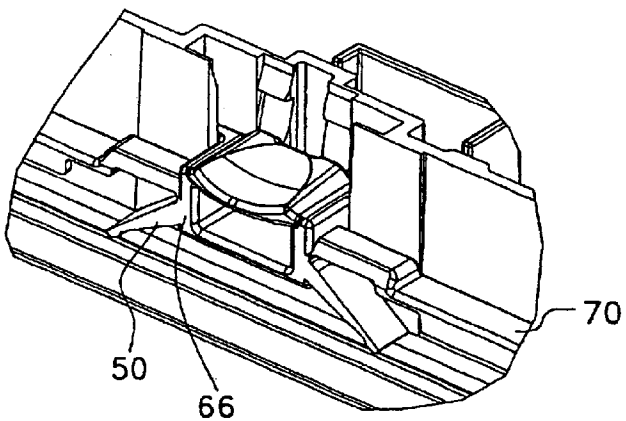
FIG. 22 is an enlarged view of a portion of FIG. 20.
Figure 21:
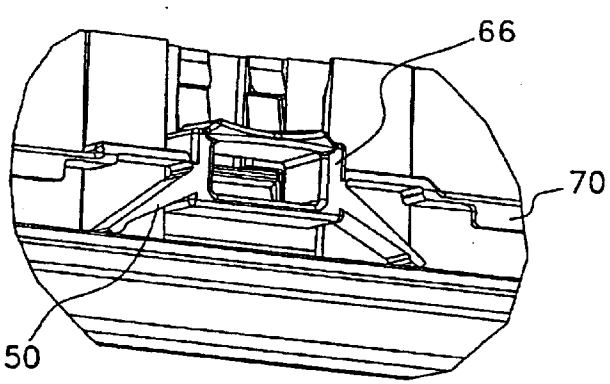
FIG. 21 is an enlarged view of a portion of FIG. 19.
Figure 23:
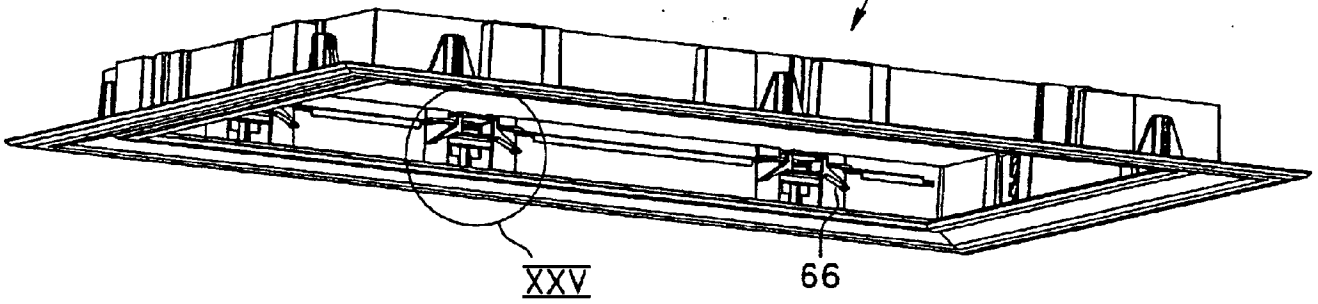
FIG. 23 is another perspective view of the exterior frame shown in FIG. 17.
Figure 24:
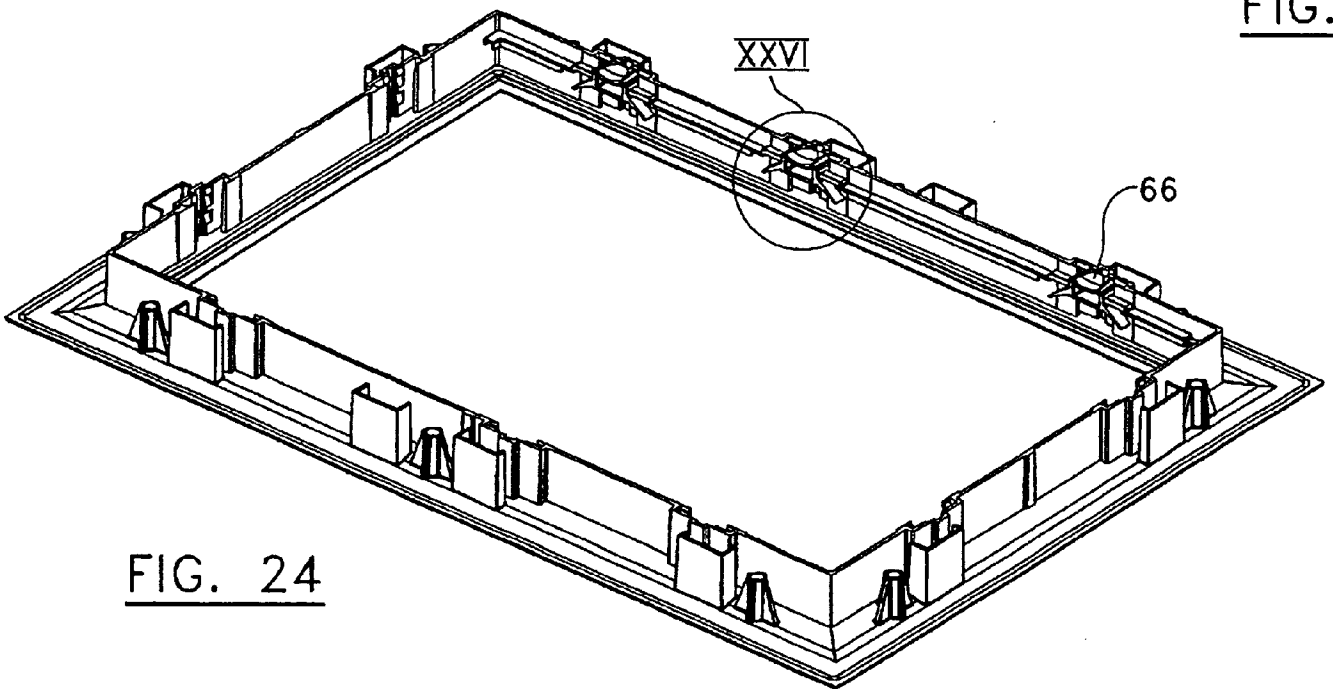
FIG. 24 is another perspective view of the exterior frame shown in FIG. 17.
Figure 26:
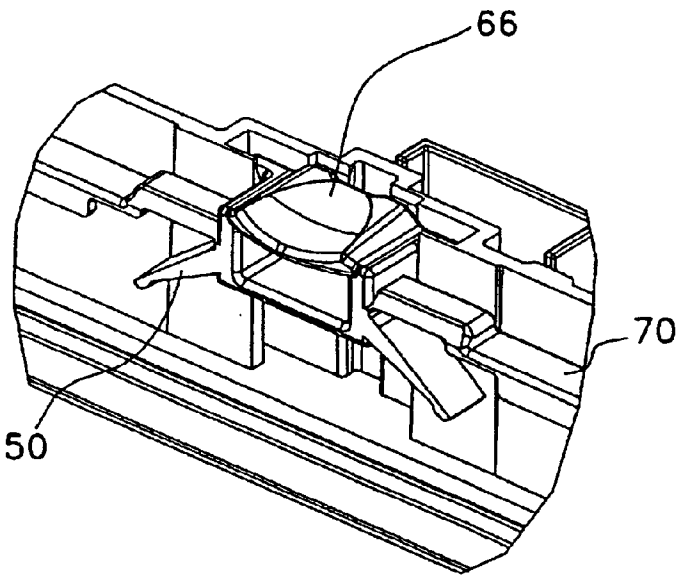
FIG. 26 is an enlarged view of a portion of FIG. 24.
Figure 25:
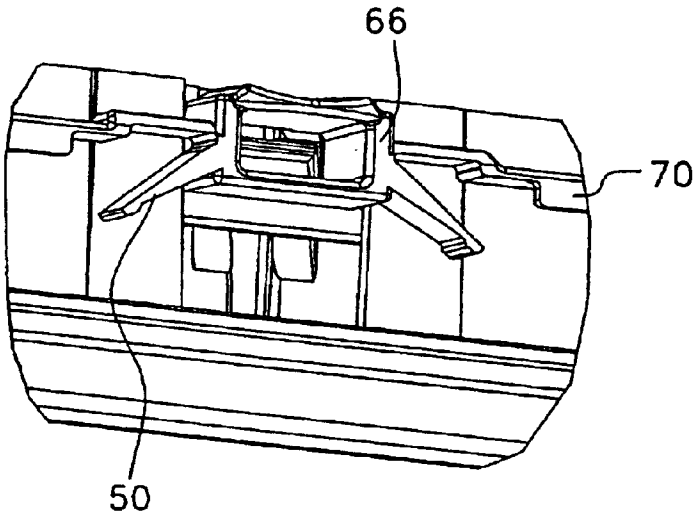
FIG. 25 is an enlarged view of a portion of FIG. 23.
Figure 27:
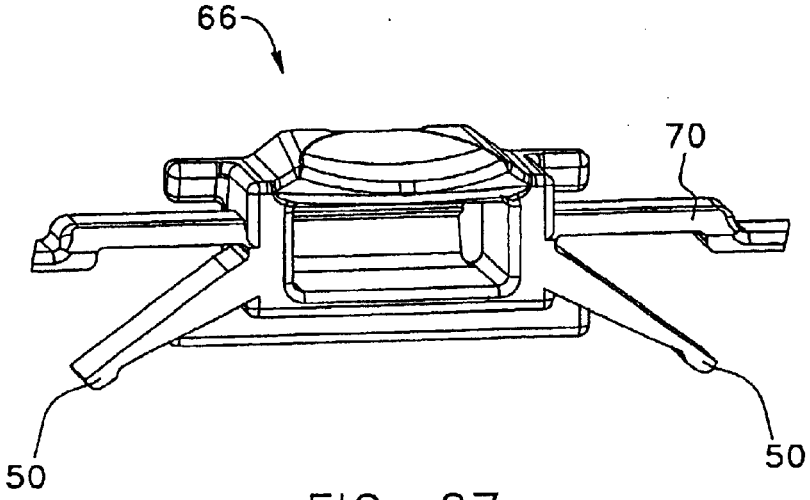
FIG. 27 is a front perspective view of a locking element of the window framework shown in FIGS. 13 to 26.
Figure 28:
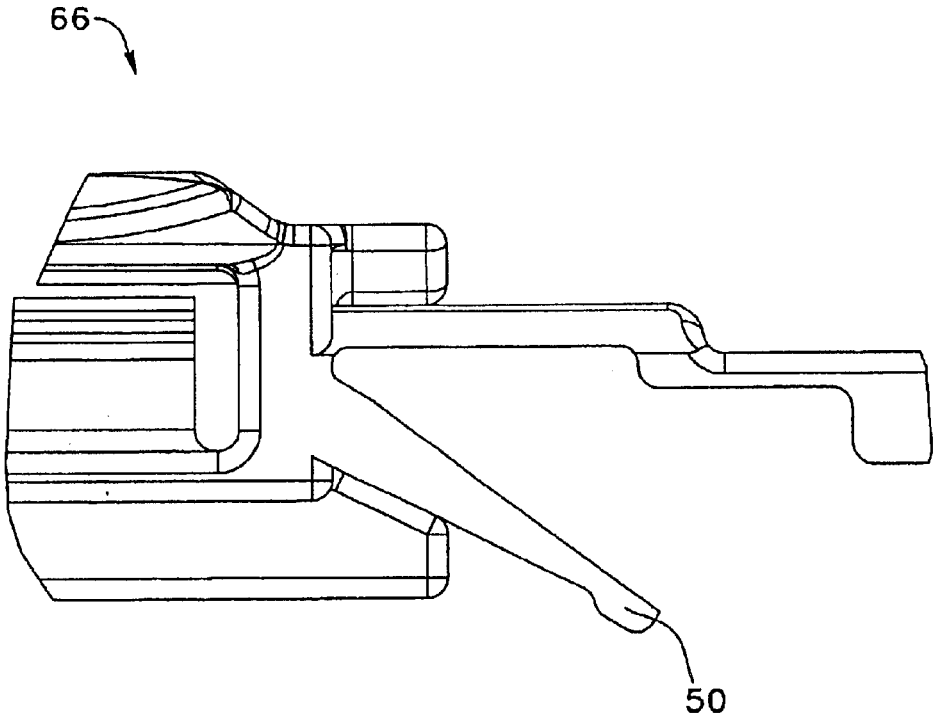
FIG. 28 is a partial front view of the locking element shown in FIG. 27.
Figure 29:
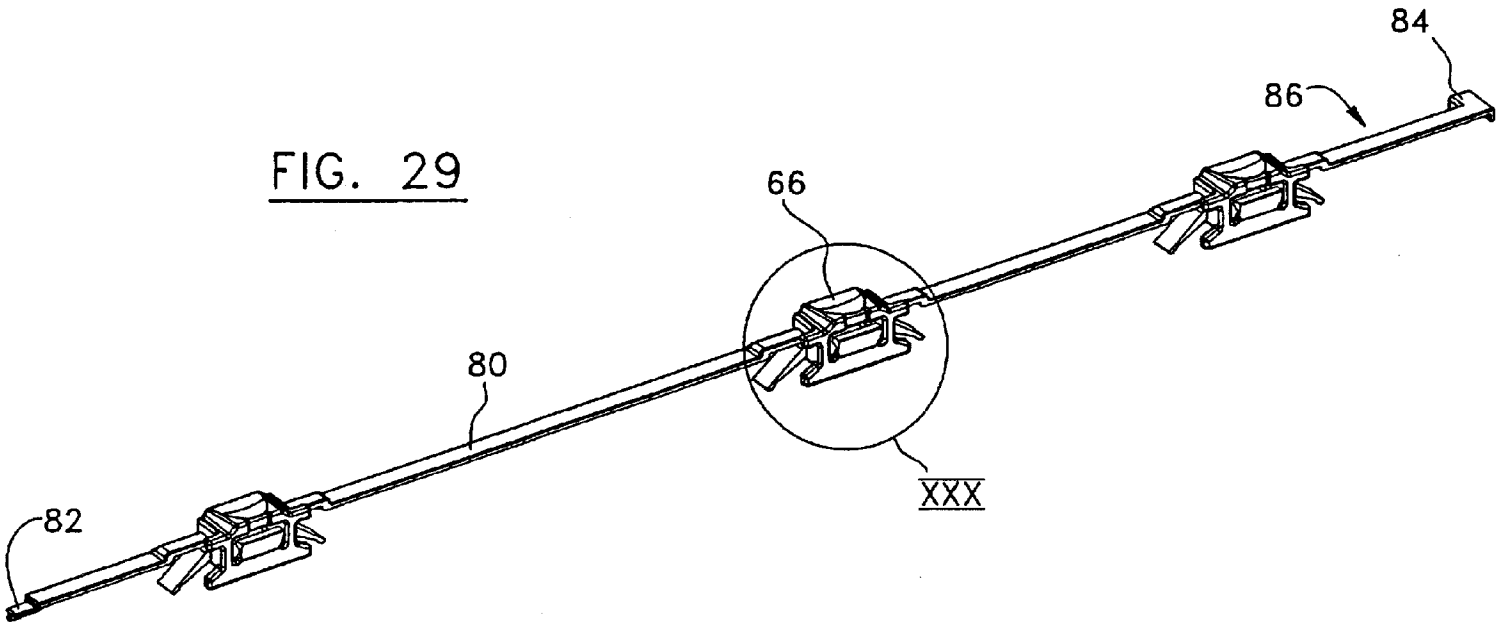
FIG. 29 is a perspective exploded partial view of a peripheral strip of the window framework shown in FIGS. 13 to 26.
Figure 30:
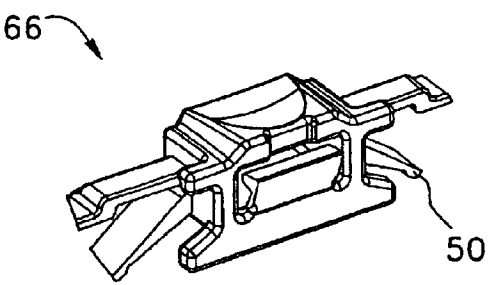
FIG. 30 is a rear and side perspective view of a locking element of the window framework shown in FIGS. 13 to 26.
Figure 31:
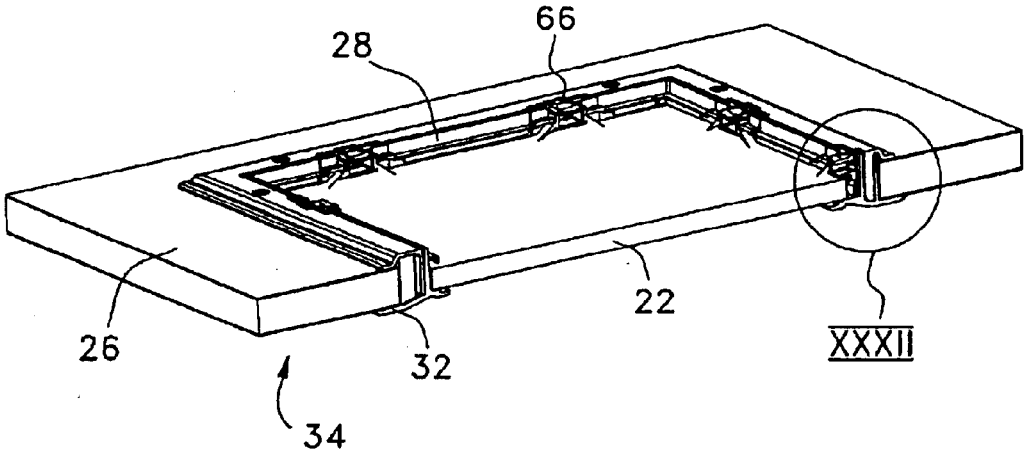
FIG. 31 is a partial perspective section view of the window framework shown in FIGS. 13 to 26.
Figure 32:
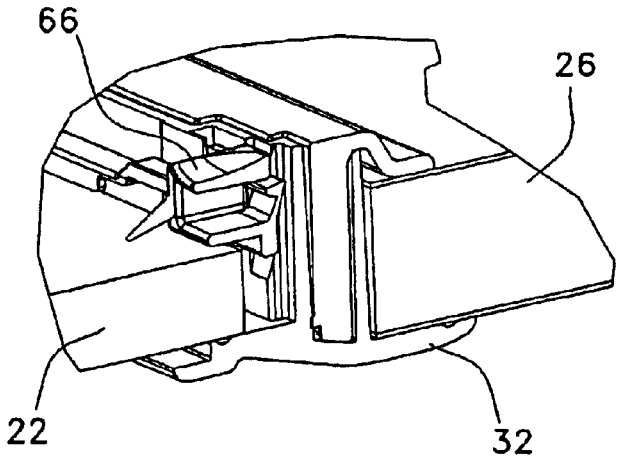
FIG. 32 is an enlarged view of a portion of FIG. 31.
Figure 33:
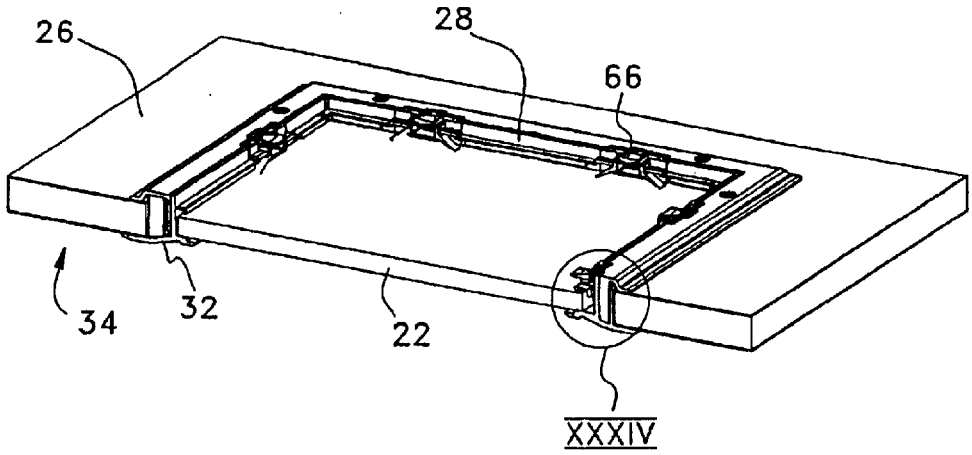
FIG. 33 is another partial perspective section view of the window framework shown in FIGS. 13 to 26.
Figure 34:
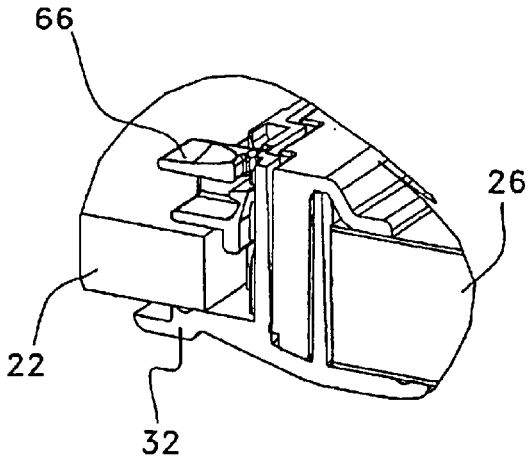
FIG. 34 is an enlarged view of a portion of FIG. 33.

Referring again to FIG. 4, the window framework 20 may preferably be provided with a recessed channel 74 extending in the peripheral wall 30 in adjacent relationship with the stop means for allowing an access from the interior side 34 to the flexible element 48. Thus, if the glass pane 22 would need to be removed, the lo installer would only have to unlock the locking means with a screw driver 76. FIG. 11 shows a screw driver 76 aligned with the recessed channel 74 of the peripheral wall 30. To unlock the locking element 66, the installer would have to place a flat screw driver tip in the recessed channel 74 of the peripheral wall 30 behind the locking element 66. FIGS. 11 and 12 show the screw driver 76 inserted in the recessed channel 74. While pushing the screw driver 76 down the recessed channel 74, the installer would disengage the flexible element 48 of the locking element 66 at the same time and the locking element 66 would then be free. Doing that with all the locking elements 66 make the glass pane 22 free to be taken off the exterior frame 28.

While the present invention has been described in detail herein with reference to FIGS. 1 to 12, it is to be understood that FIGS. 13 to 38 show a second preferred embodiment that is an integral part of the present invention.

Although the present invention has been explained hereinabove by way of preferred embodiments thereof, it should be pointed out that any modifications to these preferred embodiments, within the scope of the appended claims, is not deemed to change or alter the nature and scope of the invention.

What is claimed is:

1. A window framework for mounting a glass pane in an aperture of a panel, comprising:

an exterior frame having a peripheral wall shaped for fitting with an extending into the aperture, the wall extending between exterior and interior sides of the panel, the wall having a peripheral abutment member adjacent to the exterior side, and stop means adjacent to the interior side;

removable locking means having a flexible element lockable with said stop means when the locking means is in a locking position, and an element for holding the glass pane in position with aid of the abutment member when the locking means is in said locking position; and securing means for securing the exterior frame to the panel in said aperture.

2. The window framework according to claim 1, wherein said stop means comprises first stops built in the wall along periphery thereof.

3. The window framework according to claim 2, wherein said stop means further comprises second stops built in the wall, said second stops extending respectively in an alignment relationship with said first stops between the interior and exterior sides of the panel, thereby providing two locking positions for holding a glass pane.

4. The window framework according to claim 1, wherein the element for holding the glass pane in position is a resilient element.

5. The window framework according to claim 4, wherein the reslient element comprises two angularly oriented flexible pressure legs.

6. The window framework according to claim 1, wherein said securing means comprises an interior frame having a peripheral wall shaped for fitting into said aperture, and a connecting means for connecting said two frames together and securing the same into said aperture.

7. The window framework according to claim 6, wherein the connecting means comprises screws and holes provided in the frames for securing the exterior frame to the panel by screwing said screws in said holes.

8. The window framework according to claim 1, wherein the exterior frame further comprises an abutment wall projecting outwardly for resting on the exterior side of the panel.

9. The window framework according to claim 1, further comprising a recessed channel extending in the peripheral wall in adjacent relationship with the stop means for allowing access from the interior side to the flexible element to unlock the flexible element of the locking means.

10. The window framework according to claim 1, wherein the peripheral wall is further provided with a guiding means for guiding said locking means along the peripheral wall in and out of said locking position.

11. The window framework according to claim 10, wherein:

the guiding means includes several guides each comprising two opposed slotted guiding channels spread along the peripheral wall; and said locking means includes several locking elements each comprising opposite edges shaped for sliding in the slotted guiding channels of the corresponding guide.

12. The window framework according to claim 6, wherein the locking means comprises locking elements and links for linking said locking elements into a locking frame shaped for fitting and extending into the interior frame from the interior side.

13. The window framework according to claim 12, wherein the locking frame comprises at least two sections, each provided with female and male extremities for disengageably connecting together the at least two sections.

14. The window framework according to claim 1, wherein the framework is made of plastic material.

15. A method for mounting a glass pane in an aperture of a panel, comprising:

a) mounting an exterior frame on an exterior side of the panel, the exterior frame having a peripheral wall shaped for fitting with and extending into the aperture, the wall extending between exterior and interior sides of the panel, the wall having a peripheral abutment member adjacent to the exterior side, and stop means adjacent to the interior side;

b) securing the exterior frame to the panel in said aperture;

c) after steps a) and b), mounting the glass pane into the aperture on the interior side against the abutment member; and d) holding the glass pane in position by means of removable locking means having a flexible element lockable with said stop means when the locking means is in a locking position, and an element for holding the glass pane in position with aid of the abutment member when the locking means is in said locking position.

16. The method according to claim 15, wherein, in step d), the element for holding the glass pane in position is a resilient element.

17. The method according to claim 15, wherein, step b) includes securing means comprising an interior frame having a peripheral wall shaped for fitting into said aperture, and connecting means for connecting said two frames together and securing the same into said aperture.

18. The method according to claim 17, wherein, in step b), the connecting means comprises screws and holes provided in the frames for securing the exterior frame to the panel by screwing said screws in said holes.

19. The method according to claim 15, further comprising step e) of releasing the glass pane by inserting an elongated member into a recessed channel extending in the peripheral wall in adjacent relationship with the stop means, the recessed channel allowing access from the interior side to the flexible element to unlock the flexible element of the locking means.

20. The method according to claim 15, wherein, in step a), the peripheral wall is further provided with guiding means for guiding said locking means along the peripheral wall in and out of said locking position.

* * * * *